US008194862B2

(12) United States Patent
Herr et al.

(10) Patent No.: US 8,194,862 B2
(45) Date of Patent: Jun. 5, 2012

(54) VIDEO GAME SYSTEM WITH MIXING OF INDEPENDENT PRE-ENCODED DIGITAL AUDIO BITSTREAMS

(75) Inventors: Stefan Herr, Dierbach (DE); Ulrich Sigmund, Waldkirch (DE)

(73) Assignee: Activevideo Networks, Inc., San Jose, CA (US)

( * ) Notice: Subject to any disclaimer, the term of this patent is extended or adjusted under 35 U.S.C. 154(b) by 363 days.

(21) Appl. No.: 12/534,016

(22) Filed: Jul. 31, 2009

(65) Prior Publication Data

US 2011/0028215 A1 Feb. 3, 2011

(51) Int. Cl.
*H04R 5/00* (2006.01)
*G10L 19/00* (2006.01)

(52) U.S. Cl. ..... 381/23; 704/500

(58) Field of Classification Search ..... 381/23, 381/1, 17, 19; 704/201, 229, 500–504, E21.001; 463/35, 43

See application file for complete search history.

(56) References Cited

U.S. PATENT DOCUMENTS

| | | | | |
|---|---|---|---|---|
| 5,471,263 | A | 11/1995 | Odaka | 352/27 |
| RE35,314 | E | 8/1996 | Logg | 463/2 |
| 5,570,363 | A | 10/1996 | Holm | 370/62 |
| 5,581,653 | A | 12/1996 | Todd | 395/2.38 |
| 5,596,693 | A | 1/1997 | Needle et al. | 395/174 |
| 5,617,145 | A | 4/1997 | Huang et al. | 348/423 |
| 5,630,757 | A | 5/1997 | Gagin et al. | 463/43 |
| 5,632,003 | A | 5/1997 | Davidson et al. | 395/2.38 |
| 5,864,820 | A | 1/1999 | Case | 704/278 |
| 5,946,352 | A | 8/1999 | Rowlands et al. | 375/242 |
| 5,978,756 | A | 11/1999 | Walker et al. | 704/210 |
| 5,995,146 | A | 11/1999 | Rasmussen | 348/385 |
| 6,014,416 | A | 1/2000 | Shin et al. | 375/368 |
| 6,021,386 | A | 2/2000 | Davis et al. | 704/229 |
| 6,078,328 | A | 6/2000 | Schumann et al. | 345/418 |
| 6,084,908 | A | 7/2000 | Chiang et al. | 375/240 |
| 6,108,625 | A | 8/2000 | Kim | 704/229 |
| 6,141,645 | A | 10/2000 | Chi-Min et al. | 704/500 |

(Continued)

FOREIGN PATENT DOCUMENTS

CA 2163500 A1 5/1996

(Continued)

OTHER PUBLICATIONS

*AC-3 Digital Audio Compression Standard* Dec 20, 1995 *extract*, pp. 56-57, 65-66 and 81-86.

(Continued)

*Primary Examiner* — Hai Phan
(74) *Attorney, Agent, or Firm* — Morgan, Lewis & Bockius LLP

(57) ABSTRACT

A computer-implemented method of encoding audio includes accessing a plurality of independent audio source streams, each of which includes a sequence of source frames. Respective source frames of each sequence include respective pluralities of pulse-code modulated audio samples. Each of the plurality of independent audio source streams is separately encoded to generate a plurality of independent encoded streams, each of which corresponds to a respective independent audio source stream. The encoding includes, for respective source frames, converting respective pluralities of pulse-code modulated audio samples to respective pluralities of floating-point frequency samples that are divided into a plurality of frequency bands. An instruction to mix the plurality of independent encoded streams is received; in response, respective floating-point frequency samples of the independent encoded streams are combined. An output bitstream is generated that includes the combined respective floating-point frequency samples.

54 Claims, 14 Drawing Sheets

U.S. PATENT DOCUMENTS

| | | | | |
|---|---|---|---|---|
| 6,192,081 | B1 | 2/2001 | Chiang et al. | 375/240.16 |
| 6,205,582 | B1 | 3/2001 | Hoarty | 725/93 |
| 6,226,041 | B1 | 5/2001 | Florencio et al. | 348/473 |
| 6,236,730 | B1 | 5/2001 | Cowieson et al. | 381/18 |
| 6,243,418 | B1 | 6/2001 | Kim | 375/240.12 |
| 6,253,238 | B1 | 6/2001 | Lauder et al. | 709/217 |
| 6,292,194 | B1 | 9/2001 | Powell, III | 345/430 |
| 6,305,020 | B1 | 10/2001 | Hoarty et al. | 725/95 |
| 6,317,151 | B1 | 11/2001 | Ohsuga et al. | 348/36 |
| 6,349,284 | B1 | 2/2002 | Park et al. | 704/500 |
| 6,446,037 | B1 | 9/2002 | Fielder et al. | 704/229 |
| 6,481,012 | B1 | 11/2002 | Gordon et al. | 725/54 |
| 6,536,043 | B1 | 3/2003 | Guedalia | 725/90 |
| 6,557,041 | B2 | 4/2003 | Mallart | 709/231 |
| 6,560,496 | B1 | 5/2003 | Michener | 700/94 |
| 6,579,184 | B1 | 6/2003 | Tanskanen | 463/41 |
| 6,614,442 | B1 | 9/2003 | Ouyang et al. | 345/545 |
| 6,625,574 | B1 * | 9/2003 | Taniguchi et al. | 704/229 |
| 6,675,387 | B1 | 1/2004 | Boucher et al. | 725/105 |
| 6,687,663 | B1 | 2/2004 | McGrath et al. | 704/200.1 |
| 6,754,271 | B1 | 6/2004 | Gordon et al. | 375/240.12 |
| 6,758,540 | B1 | 7/2004 | Adolph et al. | 375/240.26 |
| 6,766,407 | B1 | 7/2004 | Lisitsa et al. | 710/316 |
| 6,807,528 | B1 | 10/2004 | Truman et al. | 704/229 |
| 6,810,528 | B1 | 10/2004 | Chatani | 725/109 |
| 6,817,947 | B2 | 11/2004 | Tanskanen | 463/41 |
| 6,931,291 | B1 | 8/2005 | Alvarez-Tinoco et al. | 700/94 |
| 6,952,221 | B1 | 10/2005 | Holtz et al. | |
| 7,272,556 | B1 | 9/2007 | Aguilar et al. | 704/230 |
| 7,742,609 | B2 | 6/2010 | Yeakel et al. | |
| 7,751,572 | B2 * | 7/2010 | Villemoes et al. | 381/23 |
| 2001/0049301 | A1 | 12/2001 | Masuda et al. | 463/33 |
| 2002/0016161 | A1 | 2/2002 | Dellien et al. | 455/403 |
| 2002/0175931 | A1 | 11/2002 | Holtz et al. | |
| 2003/0027517 | A1 | 2/2003 | Callway et al. | 455/3.01 |
| 2003/0038893 | A1 | 2/2003 | Rajamaki et al. | |
| 2003/0058941 | A1 | 3/2003 | Chen et al. | 375/240.12 |
| 2003/0088328 | A1 * | 5/2003 | Nishio et al. | 700/94 |
| 2003/0088400 | A1 * | 5/2003 | Nishio et al. | 704/201 |
| 2003/0122836 | A1 | 7/2003 | Doyle et al. | 345/559 |
| 2003/0189980 | A1 | 10/2003 | Dvir et al. | 375/240.16 |
| 2003/0229719 | A1 | 12/2003 | Iwata et al. | 709/247 |
| 2004/0139158 | A1 | 7/2004 | Datta | 709/205 |
| 2004/0157662 | A1 | 8/2004 | Tsuchiya | 463/32 |
| 2004/0184542 | A1 | 9/2004 | Fujimoto | 375/240.16 |
| 2004/0261114 | A1 | 12/2004 | Addington et al. | 725/106 |
| 2005/0015259 | A1 | 1/2005 | Thumpudi et al. | |
| 2005/0044575 | A1 | 2/2005 | Der Kuyl | 725/100 |
| 2005/0089091 | A1 | 4/2005 | Kim et al. | 375/240.01 |
| 2005/0226426 | A1 | 10/2005 | Oomen et al. | |
| 2006/0269086 | A1 * | 11/2006 | Page et al. | 381/119 |
| 2008/0154583 | A1 * | 6/2008 | Goto et al. | 704/205 |
| 2008/0253440 | A1 | 10/2008 | Srinivasan et al. | 375/240 |
| 2009/0144781 | A1 | 6/2009 | Glaser et al. | |
| 2011/0002470 | A1 | 1/2011 | Purnhagen et al. | |
| 2011/0035227 | A1 * | 2/2011 | Lee et al. | 704/500 |

FOREIGN PATENT DOCUMENTS

| | | | |
|---|---|---|---|
| EP | 0714684 | A1 | 6/1996 |
| EP | 1428562 | A2 | 6/2004 |
| FR | 2891098 | A1 | 3/2007 |
| GB | 2 378 345 | A | 2/2003 |
| WO | WO 99/00735 | A1 | 1/1999 |
| WO | WO 99/65232 | A1 | 12/1999 |
| WO | WO 01/41447 | A1 | 6/2001 |
| WO | WO 03/047710 | A2 | 6/2003 |
| WO | WO 2004/018060 | A2 | 3/2004 |
| WO | WO 2006/014362 | A1 | 2/2006 |
| WO | WO 2006/110268 | A1 | 10/2006 |

OTHER PUBLICATIONS

Benjelloun et al., *A summation algorithm for MPEG-1 coded audio signals: a first step towards audio processing in the compressed domain*, Ann. Telecommun, 55(3-4), 2000, pp. 108-116.

International Preliminary Report on Patentability, PCT/US2008/050221, Jul. 7, 2009, 6 pages.

International Search Report and Written Opinion, PCT/US2010/041133, Oct. 19, 2010, 13 pages.

Final Office Action, U.S. Appl. No. 11/620,593, Aug. 27, 2010, 41 pages.

*SAOC Use cases, Draft Requirements, and Architecture*, ISO/IEC JTC1/SC29/WG11, Hangzhou, China, Oct. 2006, 16 pages.

Broadhead, M.A., et al., "Direct Manipulation of MPEG Compressed Digital Audio," ACM Multimedia 95—Electronic Proceedings, Nov. 5-9, 1995, San Francisco California, 15 pgs.

"Digital Audio Compression Standard (AC-3, E-AC-3) Revision B, Document A/52B," Jun. 14, 2005, Advanced Television Systems Committee, 60-79 and 90-95 pages.

FFMPEG, downloaded Apr. 8, 2010, 8 pages, http://www.ffmpeg.org.

FFMPEG-0.4.9 Audio Layer 2 Tables, Including "Fixed Psycho Acoustic Model," ffmpeg-0.4.9-pre1/Libavcodec/mpegaudiotab.h, 2001, 2 pgs.

Herre, J. et al. "Thoughts on an SAOC Architecture," ISO/IEC JTC1/SC29/WG11, MPEG2006/M 13935 Oct. 2006, 9.pgs.

CD 11172-3, "Coding of Moving Pictures and Associated Audio for Digital Storage Media at up to about 1.5 MBIT/s Part 3 Audion," 173 pgs.

Todd, C.C., et al., "AC-3: Flexible Perceptual Coding for Audio Transmission and Storage," 96th Convention of Audio Engineering. Society Feb. 26-Mar. 1, 1994, 16 pgs.

Tudor, "MPEG-2 Video Compression," Electronics & Communication Engineering Journal, Dec. 1995, 15 pgs.

Vernon, S., "Dolby Digital: Audio Coding for Digital Television and Storage Applications," AES 17th International Conference on High Quality Audio Coding, Aug. 1999, 18 pgs.

The Toolame Project, Psycho_nl.c, 1999, 1 pg.

Wang, Y., "Selected Advances in Audio Compression and Compressed Domain Processing," pp. 1-68, 2001.

Wang, Y., et al., "Exploiting Excess Masking for Audio Compression," AES 17th International Conference on High Quality Audio Coding, Sep. 2-5, 1999, Florence, Italy, pp. 1-4.

Wang, Y., et al., "An Excitation Level Based Psychoacoustic Model for Audio Compression," The 7th ACM International Multimedia Conference, Oct. 30 to Nov. 4, 1999, Orlando, Florida, USA, pp. 1-4.

Wang, Y., et al., "Energy Compaction Property of the MDCT in Comparison with other Transforms," AES109th International Convention, Sep. 22-25, 2000, Los Angeles, California, USA, pp. 1-23.

Wang, Y., et al., "The Impact of the Relationship Between MDCT and DFT on Audio Compression: A Step Towards Solving the Mismatch," The First IEEE Pacific-Rim Conference on Multimedia (IEEE-PCM2000), Dec. 13-15, 2000, Sydney, Australia, pp. 1-9.

Wang, Y., et al., "A Multichannel Audio Coding Algorithm for Inter-Channel Redundancy Removal," AES110th International Convention, May 12-15, 2001 Amsterdam, The Netherlands, pp. 1-6.

Wang, Y., "A Beat-Pattern based Error Concealment Scheme for Music Delivery with Burst Packet Loss," IEEE International Conference on Multimedia and Expo (ICME2001, CD-ROM proceeding), Aug. 22-25, 2001, Tokyo, Japan, pp. 1-4.

Wang, Y., et al., "A Compressed Domain Beat Detector using MP3 Audio Bitstream," The 9th ACM International Multimedia Conference (ACM Multimedia 2001), Sep. 30-Oct. 5, 2001, Ottawa, Ontario, Canada, pp. 1-9.

Wang, Y., et al., "Schemes for Re-Compressing MP3 Audio Bitstreams," accepted by the AES111th International Convention, Nov. 30-Dec. 3, 2001, New York, USA, pp. 1-5 pgs.

International Search Report for PCT/US2006/024195 mailed Nov. 29, 2006.

International Search Report for PCT/US2006/024196 mailed Dec. 11, 2006.

International Search Report for PCT/US2008/050221 mailed Jun. 12, 2008.

International Search Report for PCT/US2006/010080 mailed Jun. 20, 2006.

Office Action for U.S. Appl. No. 11/103,838 dated Aug. 19, 2008.

Office Action for U.S. Appl. No. 11/103,838 dated Feb. 5, 2009.

Office Action for U.S. Appl. No. 11/103,838 dated May 12, 2009.

Office Action for U.S. Appl. No. 11/103,838 dated Nov. 19, 2009.

Office Action for U.S. Appl. No. 11/178,183 mailed Feb. 19, 2010.

Office Action for U.S. Appl. No. 11/178,182 mailed Feb. 23, 2010.
Office Action for U.S. Appl. No. 11/178,189 mailed Jul. 23, 2009.
Office Action for U.S. Appl. No. 11/178,189 mailed Mar. 15, 2010.
Office Action for U.S. Appl. No. 11/620,593 mailed Apr. 21, 2009.
Office Action for U.S. Appl. No. 11/620,593 mailed Dec. 23, 2009.
Office Action for U.S. Appl. No. 11/620,593 mailed Mar. 19, 2010.
Office Action for U.S. Appl. No. 11/178,177 mailed Mar. 29, 2010.
Active Video Networks, Office Action, U.S. Appl. No. 11/620,593, Sep. 15, 2011, 104 pgs.
Active Video Networks, Office Action, U.S. Appl. No. 11/620,593, Jan. 24, 2011, 96 pgs.
TAG Networks, Office Action, CN 200880001325.4, Jun. 22, 2011, 4 pgs.

* cited by examiner

VIDEO GAME SYSTEM WITH MIXING OF INDEPENDENT PRE-ENCODED DIGITAL AUDIO BITSTREAMS

RELATED APPLICATIONS

This application is related to U.S. patent application Ser. Nos. 11/178,189, filed Jul. 8, 2005, entitled "Video Game System Using Pre-Encoded Macro Blocks," and 11/620,593, filed Jan. 5, 2007, entitled "Video Game System Using Pre-Encoded Digital Audio Mixing," both of which are incorporated by reference herein in their entirety.

FIELD OF THE INVENTION

The present invention relates generally to an interactive video-game system, and more specifically to an interactive video-game system using mixing of digital audio signals encoded prior to execution of the video game.

BACKGROUND

Video games are a popular form of entertainment. Multiplayer games, where two or more individuals play simultaneously in a common simulated environment, are becoming increasingly common, especially as more users are able to interact with one another using networks such as the World Wide Web (WWW), which is also referred to as the Internet. Single-player games also may be implemented in a networked environment. Implementing video games in a networked environment poses challenges with regard to audio playback.

In some video games implemented in a networked environment, a transient sound effect may be implemented by temporarily replacing background sound. Background sound, such as music, may be present during a plurality of frames of video over an extended time period. Transient sound effects may be present during one or more frames of video, but over a smaller time interval than the background sound. Through a process known as audio stitching, the background sound is not played when a transient sound effect is available. In general, audio stitching is a process of generating sequences of audio frames that were previously encoded off-line. A sequence of audio frames generated by audio stitching does not necessarily form a continuous stream of the same content. For example, a frame containing background sound can be followed immediately by a frame containing a sound effect. To smooth a transition from the transient sound effect back to the background sound, the background sound may be attenuated and the volume slowly increased over several frames of video during the transition. However, interruption of the background sound still is noticeable to users.

Accordingly, it is desirable to allow for simultaneous playback of sound effects and background sound, such that sound effects are played without interruption to the background sound. The sound effects and background sound may correspond to multiple pulse-code modulated (PCM) bitstreams. In a standard audio processing system, multiple PCM bitstreams may be mixed together and then encoded in a format such as the MPEG-1 Layer II format in real time. However, limitations on computational power may make this approach impractical when implementing multiple video games in a networked environment.

There is a need, therefore, for a system and method of merging audio data from multiple sources without performing real-time mixing of PCM bitstreams and real-time encoding of the resulting bitstream to compressed audio.

SUMMARY

In some embodiments, a computer-implemented method of encoding audio includes, prior to execution of a video game by a computer system, accessing a plurality of independent audio source streams, each of which includes a sequence of source frames. Respective source frames of each sequence include respective pluralities of pulse-code modulated audio samples. Also prior to execution of the video game, each of the plurality of independent audio source streams is separately encoded to generate a plurality of independent encoded streams, each of which corresponds to a respective independent audio source stream. The encoding includes, for respective source frames, converting respective pluralities of pulse-code modulated audio samples to respective pluralities of floating-point frequency samples that are divided into a plurality of frequency bands. During execution of the video game by the computer system, an instruction to mix the plurality of independent encoded streams is received; in response, respective floating-point frequency samples of the independent encoded streams are combined. An output bitstream is generated that includes the combined respective floating-point frequency samples.

In some embodiments, a computer-implemented method of encoding audio includes, prior to execution of a video game by a computer system, storing a plurality of independent encoded audio streams in a computer-readable medium of the computer system. Each independent encoded stream includes a sequence of frames. Respective frames of each sequence include respective pluralities of floating-point frequency samples. The respective pluralities of floating-point frequency samples are divided into a plurality of frequency bands. The method further includes, during execution of the video game by the computer system, receiving an instruction to mix the plurality of independent encoded streams. In response to the instruction to mix the plurality of independent encoded streams, the plurality of independent encoded audio streams stored in the computer-readable medium is accessed and the respective floating-point frequency samples of the independent encoded streams are combined. An output bitstream is generated that includes the combined respective floating-point frequency samples.

In some embodiments, a system for encoding audio includes memory, one or more processors, and one or more programs stored in the memory and configured for execution by the one or more processors. The one or more programs include instructions, configured for execution prior to execution of a video game, for accessing a plurality of independent audio source streams, each of which includes a sequence of source frames. Respective source frames of each sequence include respective pluralities of pulse-code modulated audio samples. The one or more programs also include instructions, configured for execution prior to execution of the video game, for separately encoding each of the plurality of independent audio source streams to generate a plurality of independent encoded streams, each of which corresponds to a respective independent audio source stream. The encoding includes, for respective source frames, converting respective pluralities of pulse-code modulated audio samples to respective pluralities of floating-point frequency samples that are divided into a plurality of frequency bands. The one or more programs further include instructions, configured for execution during execution of the video game, for combining respective floating-point frequency samples of the independent encoded streams, in response to an instruction to mix the plurality of independent encoded streams; and instructions, configured for execution during execution of the video game, for generating an output bitstream that includes the combined respective floating-point frequency samples.

In some embodiments, a system for encoding audio includes memory, one or more processors, and one or more programs stored in the memory and configured for execution by the one or more processors. The one or more programs include instructions for storing a plurality of independent encoded audio streams in the memory prior to execution of a video game by the one or more processors. Each independent encoded stream includes a sequence of frames. Respective frames of each sequence include respective pluralities of floating-point frequency samples. The respective pluralities of floating-point frequency samples are divided into a plurality of frequency bands. The one or more programs also include instructions for accessing the plurality of independent encoded audio streams stored in the memory and combining the respective floating-point frequency samples of the independent encoded streams, in response to an instruction to mix the plurality of independent encoded streams during execution of the video game by the one or more processors. The one or more programs further include instructions for generating an output bitstream that includes the combined respective floating-point frequency samples.

In some embodiments, a computer readable storage medium for use in encoding audio stores one or more programs configured to be executed by a computer system. The one or more programs include instructions, configured for execution prior to execution of a video game by the computer system, for accessing a plurality of independent audio source streams, each of which includes a sequence of source frames. Respective source frames of each sequence include respective pluralities of pulse-code modulated audio samples. The one or more programs also include instructions, configured for execution prior to execution of the video game by the computer system, for separately encoding each of the plurality of independent audio source streams to generate a plurality of independent encoded streams, each of which corresponds to a respective independent audio source stream. The encoding includes, for respective source frames, converting respective pluralities of pulse-code modulated audio samples to respective pluralities of floating-point frequency samples that are divided into a plurality of frequency bands. The one or more programs further include instructions, configured for execution during execution of the video game by the computer system, for combining respective floating-point frequency samples of the independent encoded streams, in response to an instruction to mix the plurality of independent encoded streams; and instructions, configured for execution during execution of the video game by the computer system, for generating an output bitstream that includes the combined respective floating-point frequency samples.

In some embodiments, a computer readable storage medium for use in encoding audio stores one or more programs configured to be executed by a computer system. The one or more programs include instructions for accessing a plurality of independent encoded audio streams stored in a memory of the computer system prior to execution of a video game by the computer system, in response to an instruction to mix the plurality of independent encoded streams during execution of the video game by the computer system. Each independent encoded stream includes a sequence of frames. Respective frames of each sequence include respective pluralities of floating-point frequency samples. The respective pluralities of floating-point frequency samples are divided into a plurality of frequency bands. The one or more programs also include instructions for combining the respective floating-point frequency samples of the independent encoded streams, in response to the instruction to mix the plurality of independent encoded streams, and instructions for generating an output bitstream that includes the combined respective floating-point frequency samples.

BRIEF DESCRIPTION OF THE DRAWINGS

Like reference numerals refer to corresponding parts throughout the drawings.

DETAILED DESCRIPTION OF EMBODIMENTS

Reference will now be made in detail to embodiments, examples of which are illustrated in the accompanying drawings. In the following detailed description, numerous specific details are set forth in order to provide a thorough understanding of the present invention. However, it will be apparent to one of ordinary skill in the art that the present invention may be practiced without these specific details. In other instances, well-known methods, procedures, components, and circuits have not been described in detail so as not to unnecessarily obscure aspects of the embodiments.

Figure 1:
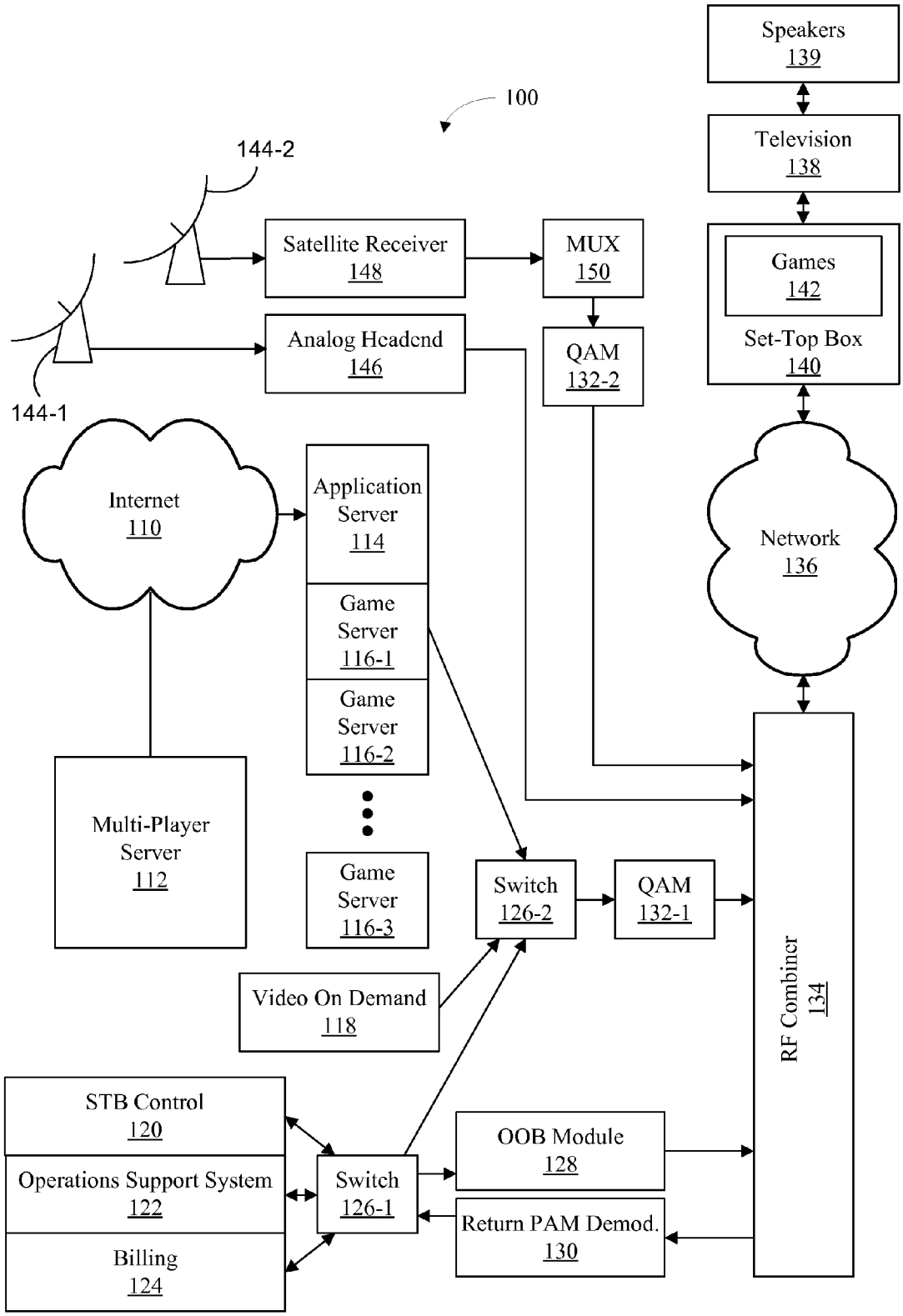
FIG. 1 is a block diagram illustrating an embodiment of a cable television system.

FIG. 1 is a block diagram illustrating an embodiment of a cable television system 100 for receiving orders for and providing content, such as one or more video games, to one or more users (including multi-user video games). Several content data streams may be transmitted to respective subscribers and respective subscribers may, in turn, order services or transmit user actions in a video game. Satellite signals, such as analog television signals, may be received using satellite antennas 144. Analog signals may be processed in analog headend 146, coupled to radio frequency (RF) combiner 134 and transmitted to a set-top box (STB) 140 via a network 136. In addition, signals may be processed in satellite receiver 148, coupled to multiplexer (MUX) 150, converted to a digital format using a quadrature amplitude modulator (QAM) 132-2 (such as 256-level QAM), coupled to the radio frequency (RF) combiner 134 and transmitted to the STB 140 via the network 136. Video on demand (VOD) server 118 may provide signals corresponding to an ordered movie to switch 126-2, which couples the signals to QAM 132-1 for conversion into the digital format. These digital signals are coupled to the radio frequency (RF) combiner 134 and transmitted to the STB 140 via the network 136.

The STB 140 may display one or more video signals, including those corresponding to video-game content discussed below, on television or other display device 138 and may play one or more audio signals, including those corresponding to video-game content discussed below, on speakers 139. Speakers 139 may be integrated into television 138 or may be separate from television 138. While FIG. 1 illustrates one subscriber STB 140, television or other display device 138, and speakers 139, in other embodiments there may be additional subscribers, each having one or more STBs, televisions or other display devices, and/or speakers.

The cable television system 100 may also include an application server 114 and a plurality of game servers 116. The application server 114 and the plurality of game servers 116 may be located at a cable television system headend. While a single instance or grouping of the application server 114 and the plurality of game servers 116 is illustrated in FIG. 1, other embodiments may include additional instances in one or more headends. The servers and/or other computers at the one or more headends may run an operating system such as Windows, Linux, Unix, or Solaris.

The application server 114 and one or more of the game servers 116 may provide video-game content corresponding to one or more video games ordered by one or more users. In the cable television system 100 there may be a many-to-one correspondence between respective users and an executed copy of one of the video games. The application server 114 may access and/or log game-related information in a database. The application server 114 may also be used for reporting and pricing. One or more game engines (also called game engine modules) 248 (FIG. 2) in the game servers 116 are designed to dynamically generate video-game content using pre-encoded video and/or audio data. In an exemplary embodiment, the game servers 116 use video encoding that is compatible with an MPEG compression standard and use audio encoding that is compatible with the MPEG-1 Layer II compression standard.

The video-game content is coupled to the switch 126-2 and converted to the digital format in the QAM 132-1. In an exemplary embodiment with 256-level QAM, a narrowcast sub-channel (having a bandwidth of approximately 6 MHz, which corresponds to approximately 38 Mbps of digital data) may be used to transmit 10 to 30 video-game data streams for a video game that utilizes between 1 and 4 Mbps.

These digital signals are coupled to the radio frequency (RF) combiner 134 and transmitted to STB 140 via the network 136. The application server 114 may also access, via Internet 110, persistent player or user data in a database stored in multi-player server 112. The application server 114 and the plurality of game servers 116 are further described below with reference to FIG. 2.

The STB 140 may optionally include a client application, such as games 142, that receives information corresponding to one or more user actions and transmits the information to one or more of the game servers 116. The game applications 142 may also store video-game content prior to updating a frame of video on the television 138 and playing an accompanying frame of audio on the speakers 139. The television 138 may be compatible with an NTSC format or a different format, such as PAL or SECAM. The STB 140 is described further below with reference to FIG. 3.

The cable television system 100 may also include STB control 120, operations support system 122 and billing system 124. The STB control 120 may process one or more user actions, such as those associated with a respective video game, that are received using an out-of-band (OOB) sub-channel using return pulse amplitude (PAM) demodulator 130 and switch 126-1. There may be more than one OOB sub-channel. While the bandwidth of the OOB sub-channel(s) may vary from one embodiment to another, in one embodiment, the bandwidth of each OOB sub-channel corresponds to a bit rate or data rate of approximately 1 Mbps. The operations support system 122 may process a subscriber's order for a respective service, such as the respective video game, and update the billing system 124. The STB control 120, the operations support system 122 and/or the billing system 124 may also communicate with the subscriber using the OOB sub-channel via the switch 126-1 and the OOB module 128, which converts signals to a format suitable for the OOB sub-channel. Alternatively, the operations support system 122 and/or the billing system 124 may communicate with the subscriber via another communications link such as an Internet connection or a communications link provided by a telephone system.

The various signals transmitted and received in the cable television system 100 may be communicated using packet-based data streams. In an exemplary embodiment, some of the packets may utilize an Internet protocol, such as User Datagram Protocol (UDP). In some embodiments, networks, such as the network 136, and coupling between components in the cable television system 100 may include one or more instances of a wireless area network, a local area network, a transmission line (such as a coaxial cable), a land line and/or an optical fiber. Some signals may be communicated using plain-old-telephone service (POTS) and/or digital telephone networks such as an Integrated Services Digital Network (ISDN). Wireless communication may include cellular telephone networks using an Advanced Mobile Phone System (AMPS), Global System for Mobile Communication (GSM), Code Division Multiple Access (CDMA) and/or Time Division Multiple Access (TDMA), as well as networks using an IEEE 802.11 communications protocol, also known as WiFi, and/or a Bluetooth communications protocol.

While FIG. 1 illustrates a cable television system, the system and methods described may be implemented in a satellite-based system, the Internet, a telephone system and/or a terrestrial television broadcast system. The cable television system 100 may include additional elements and/or omit one or more elements. In addition, two or more elements may be combined into a single element and/or a position of one or more elements in the cable television system 100 may be changed. In some embodiments, for example, the application server 114 and its functions may be merged with and into the game servers 116.

Figure 2:
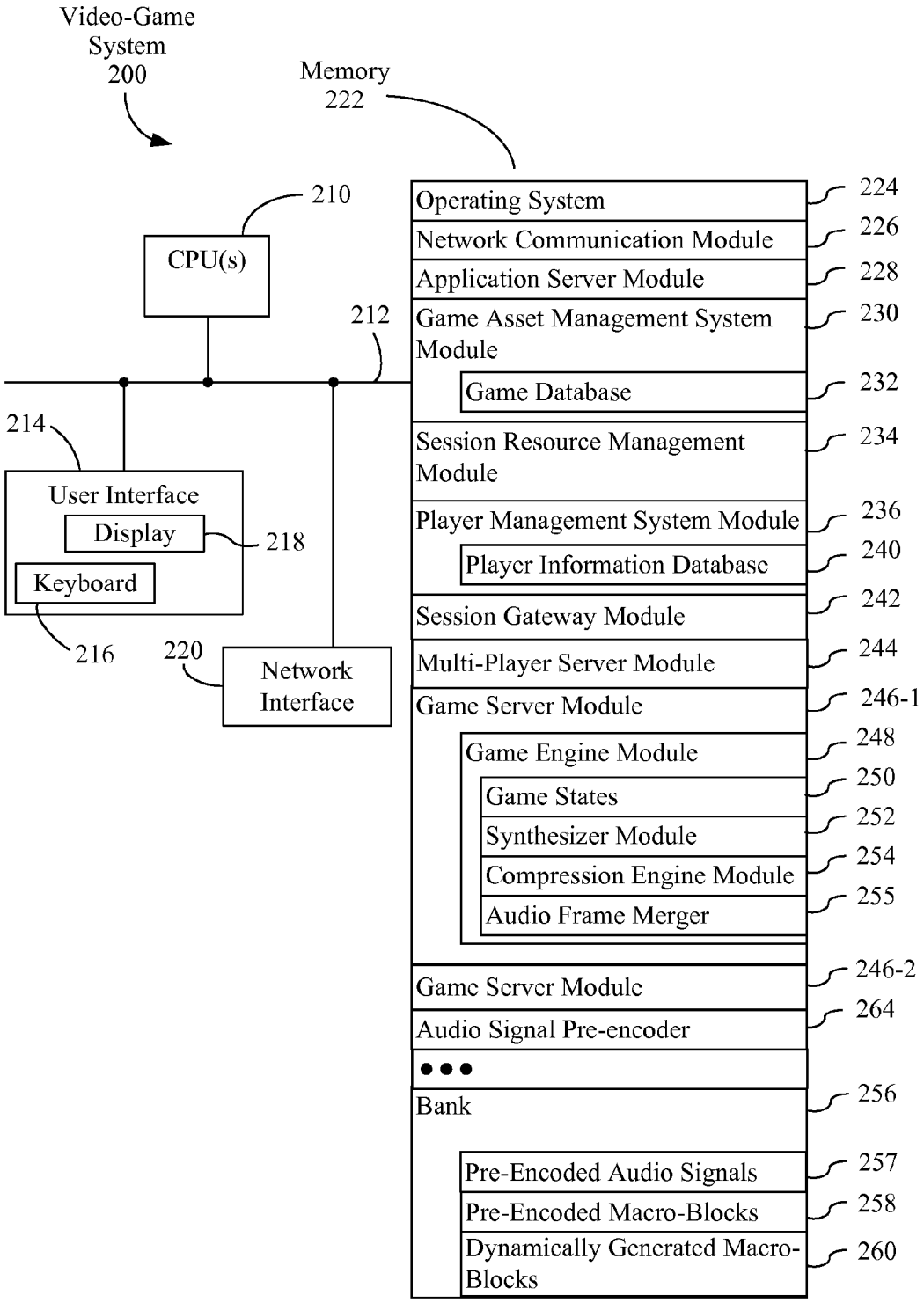
FIG. 2 is a block diagram illustrating an embodiment of a video-game system.

FIG. 2 is a block diagram illustrating an embodiment of a video-game system 200. The video-game system 200 may include one or more data processors, video processors, and/or central processing units (CPUs) 210, one or more optional user interfaces 214, a communications or network interface 220 for communicating with other computers, servers and/or one or more STBs (such as the STB 140 in FIG. 1), memory 222 and one or more signal lines 212 for coupling these components to one another. The one or more data processors, video processors, and/or central processing units (CPUs) 210 may be configured or configurable for multi-threaded or parallel processing. The user interface 214 may have one or more keyboards 216 and/or displays 218. The one or more signal lines 212 may constitute one or more communications busses.

Memory 222 may include high-speed random access memory and/or non-volatile memory, including ROM, RAM, EPROM, EEPROM, one or more flash disc drives, one or more optical disc drives, one or more magnetic disk storage devices, and/or other solid state storage devices. Memory 222 may optionally include one or more storage devices remotely located from the CPU(s) 210. Memory 222, or alternately non-volatile memory device(s) within memory 222, comprises a computer readable storage medium. Memory 222 may store an operating system 224 (e.g., LINUX, UNIX, Windows, or Solaris) that includes procedures for handling basic system services and for performing hardware dependent tasks. Memory 222 may also store communication procedures in a network communication module 226. The communication procedures are used for communicating with one or more STBs, such as the STB 140 (FIG. 1), and with other servers and computers in the video-game system 200.

Memory 222 may also include the following elements, or a subset or superset of such elements, including an applications server module 228, a game asset management system module 230, a session resource management module 234, a player management system module 236, a session gateway module 242, a multi-player server module 244, one or more game server modules 246, an audio signal pre-encoder 264, and a bank 256 for storing macro-blocks and pre-encoded audio signals. The game asset management system module 230 may include a game database 232, including pre-encoded macro-blocks, pre-encoded audio signals, and executable code corresponding to one or more video games. The player management system module 236 may include a player information database 240 including information such as a user's name, account information, transaction information, preferences for customizing display of video games on the user's STB(s) 140 (FIG. 1), high scores for the video games played, rankings and other skill level information for video games played, and/or a persistent saved game state for video games that have been paused and may resume later. Each instance of the game server module 246 may include one or more game engine modules 248. Game engine module 248 may include games states 250 corresponding to one or more sets of users playing one or more video games, synthesizer module 252, one or more compression engine modules 254, and one or more audio frame mergers (also referred to as audio frame stitchers) 255. The bank 256 may include pre-encoded audio signals 257 corresponding to one or more video games, pre-encoded macro-blocks 258 corresponding to one or more video games, and/or dynamically generated or encoded macro-blocks 260 corresponding to one or more video games.

The game server modules 246 may run a browser application, such as Windows Explorer, Netscape Navigator or FireFox from Mozilla, to execute instructions corresponding to a respective video game. The browser application, however, may be configured to not render the video-game content in the game server modules 246. Rendering the video-game content may be unnecessary, since the content is not displayed by the game servers, and avoiding such rendering enables each game server to maintain many more game states than would otherwise be possible. The game server modules 246 may be executed by one or multiple processors. Video games may be executed in parallel by multiple processors. Games may also be implemented in parallel threads of a multi-threaded operating system.

Although FIG. 2 shows the video-game system 200 as a number of discrete items, FIG. 2 is intended more as a functional description of the various features which may be present in a video-game system rather than as a structural schematic of the embodiments described herein. In practice, and as recognized by those of ordinary skill in the art, the functions of the video-game system 200 may be distributed over a large number of servers or computers, with various groups of the servers performing particular subsets of those functions. Items shown separately in FIG. 2 could be combined and some items could be separated. For example, some items shown separately in FIG. 2 could be implemented on single servers and single items could be implemented by one or more servers. The actual number of servers in a video-game system and how features, such as the game server modules 246 and the game engine modules 248, are allocated among them will vary from one implementation to another, and may depend in part on the amount of information stored by the system and/or the amount of data traffic that the system must handle during peak usage periods as well as during average usage periods. In some embodiments, audio signal pre-encoder 264 is implemented on a separate computer system, which may be called a pre-encoding system, from the video game system(s) 200.

Furthermore, each of the above identified elements in memory 222 may be stored in one or more of the previously mentioned memory devices. Each of the above identified modules corresponds to a set of instructions for performing a function described above. The above identified modules or programs (i.e., sets of instructions) need not be implemented as separate software programs, procedures or modules, and thus various subsets of these modules may be combined or otherwise re-arranged in various embodiments. In some embodiments, memory 222 may store a subset of the modules and data structures identified above. Memory 222 also may store additional modules and data structures not described above.

Figure 3:
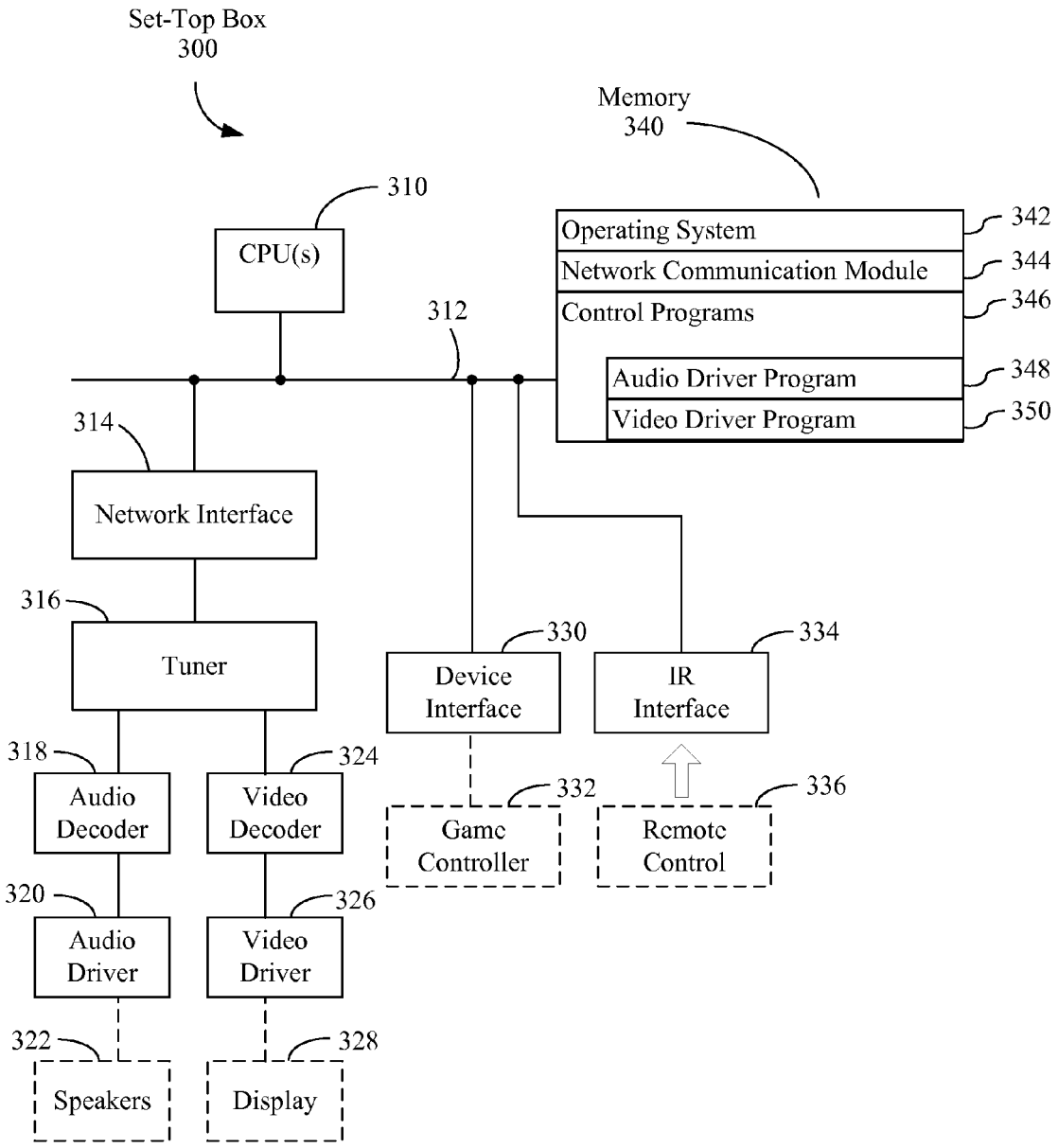
FIG. 3 is a block diagram illustrating an embodiment of a set top box.

FIG. 3 is a block diagram illustrating an embodiment of a set top box (STB) 300, such as STB 140 (FIG. 1). STB 300 may include one or more data processors, video processors, and/or central processing units (CPUs) 310, a communications or network interface 314 for communicating with other computers and/or servers such as video game system 200 (FIG. 2), a tuner 316, an audio decoder 318, an audio driver 320 coupled to one or more speakers 322, a video decoder 324, and a video driver 326 coupled to a display 328. STB 300 also may include one or more device interfaces 330, one or more IR interfaces 334, memory 340 and one or more signal lines 312 for coupling components to one another. The one or more data processors, video processors, and/or central processing units (CPUs) 310 may be configured or configurable for multi-threaded or parallel processing. The one or more signal lines 312 may constitute one or more communications busses. The one or more device interfaces 330 may be coupled to one or more game controllers 332. The one or more IR interfaces 334 may use IR signals to communicate wirelessly with one or more remote controls 336.

Memory 340 may include high-speed random access memory and/or non-volatile memory, including ROM, RAM, EPROM, EEPROM, one or more flash disc drives, one or more optical disc drives, one or more magnetic disk storage devices, and/or other solid state storage devices. Memory 340 may optionally include one or more storage devices remotely located from the CPU(s) 210. Memory 340, or alternately non-volatile memory device(s) within memory 340, comprises a computer readable storage medium. Memory 340 may store an operating system 342 that includes procedures (or a set of instructions) for handling basic system services and for performing hardware dependent tasks. The operating system 342 may be an embedded operating system (e.g., Linux, OS9 or Windows) or a real-time operating system suitable for use on industrial or commercial devices (e.g., VxWorks by Wind River Systems, Inc). Memory 340 may store communication procedures in a network communication module 344. The communication procedures are used for communicating with computers and/or servers such as video game system 200 (FIG. 2). Memory 340 may also include control programs 346, which may include an audio driver program 348 and a video driver program 350.

STB 300 transmits order information and information corresponding to user actions and receives video-game content via the network 136. Received signals are processed using network interface 314 to remove headers and other information in the data stream containing the video-game content. Tuner 316 selects frequencies corresponding to one or more sub-channels. The resulting audio signals are processed in audio decoder 318. In some embodiments, audio decoder 318 is an MPEG-1 Layer II (i.e., MP2) decoder, also referred to as an MP2 decoder, implemented in accordance with the MPEG-1 Layer II standard as defined in ISO/IEC standard 11172-3 (including the original 1993 version and the "Cor1: 1996" revision), which is incorporated by reference herein in its entirety. The resulting video signals are processed in video decoder 324. In some embodiments, video decoder 314 is an MPEG-1 decoder, MPEG-2 decoder, H.264 decoder, or WMV decoder. In general, audio and video standards can be mixed arbitrarily, such that the video decoder 324 need not correspond to the same standard as the audio decoder 318. The video content output from the video decoder 314 is converted to an appropriate format for driving display 328 using video driver 326. Similarly, the audio content output from the audio decoder 318 is converted to an appropriate format for driving speakers 322 using audio driver 320. User commands or actions input to the game controller 332 and/or the remote control 336 are received by device interface 330 and/or by IR interface 334 and are forwarded to the network interface 314 for transmission.

The game controller 332 may be a dedicated video-game console, such as those provided by Sony Playstation®, Nintendo®, Sega® and Microsoft Xbox®, or a personal computer. The game controller 332 may receive information corresponding to one or more user actions from a game pad, keyboard, joystick, microphone, mouse, one or more remote controls, one or more additional game controllers or other user interface such as one including voice recognition technology. The display 328 may be a cathode ray tube, a liquid crystal display, or any other suitable display device in a television, a computer or a portable device, such as a video game controller 332 or a cellular telephone. In some embodiments, speakers 322 are embedded in the display 328. In some embodiments, speakers 322 include left and right speakers (e.g., respectively positioned to the left and right of the display 328).

In some embodiments, the STB 300 may perform a smoothing operation on the received video-game content prior to displaying the video-game content. In some embodiments, received video-game content is decoded, displayed on the display 328, and played on the speakers 322 in real time as it is received. In other embodiments, the STB 300 stores the received video-game content until a full frame of video is received. The full frame of video is then decoded and displayed on the display 328 while accompanying audio is decoded and played on speakers 322.

Although FIG. 3 shows the STB 300 as a number of discrete items, FIG. 3 is intended more as a functional description of the various features which may be present in a set top box rather than as a structural schematic of the embodiments described herein. In practice, and as recognized by those of ordinary skill in the art, items shown separately in FIG. 3 could be combined and some items could be separated. Furthermore, each of the above identified elements in memory 340 may be stored in one or more of the previously mentioned memory devices. Each of the above-identified modules corresponds to a set of instructions for performing a function described above. The above identified modules or programs (i.e., sets of instructions) need not be implemented as separate software programs, procedures or modules, and thus various subsets of these modules may be combined or otherwise re-arranged in various embodiments. In some embodiments, memory 340 may store a subset of the modules and data structures identified above. Memory 340 also may store additional modules and data structures not described above.

Figure 4A:
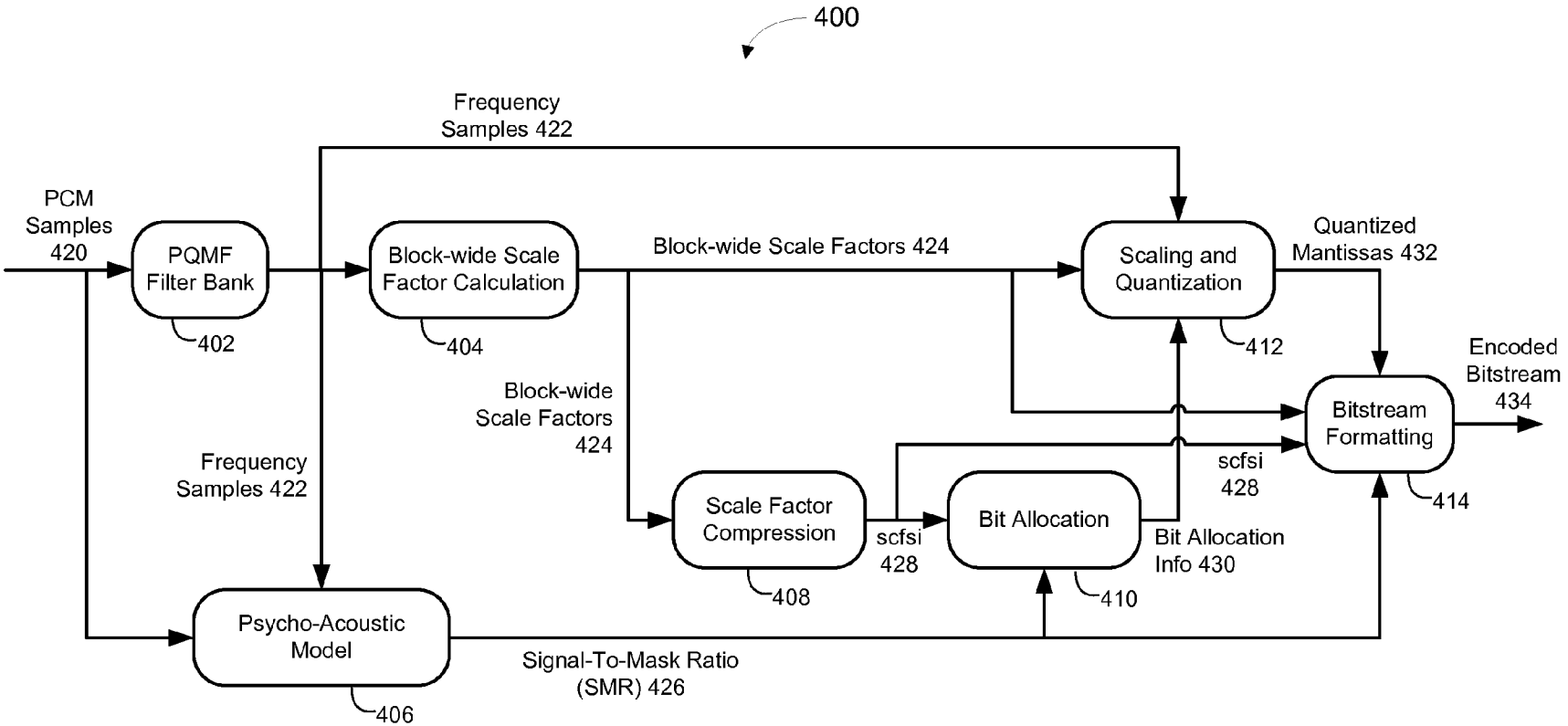
FIGS. 4A-4C are block diagrams of systems for performing audio encoding in accordance with some embodiments.

FIG. 4A is a block diagram of a system 400 for performing MPEG-1 Layer II encoding of frames of audio data in an audio source stream in accordance with some embodiments. The system 400 produces an encoded bitstream 434 that includes compressed frames corresponding to respective frames in the audio source stream.

In the system 400, a Pseudo-Quadrature Mirror Filtering (PQMF) filter bank 402 receives 1152 Pulse-Code Modulated (PCM) audio samples 420 for a respective channel of a respective frame in the audio source stream. If the audio source stream is monaural (i.e., mono), there is only one channel; if the audio source stream is stereo, there are two channels (e.g., left (L) and right (R)). The PQMF filter bank 402 performs time-to-frequency domain conversion of the 1152 PCM samples 420 per channel to a maximum of 1152 floating point (FP) frequency samples 422 per channel, arranged in 3 blocks of 12 samples for each of a maximum of 32 bands, sometimes referred to as sub-bands. (As used herein, the term "floating point frequency sample" includes samples that are shifted into an integer range. For example, FP frequency samples may be shifted from an original floating point range of [−1.0, 1.0] to a 16-bit integer range by multiplying by 32,768.) The time-to-frequency domain conversion performed by the PQMF filter bank 402 is computationally expensive and time consuming.

A block-wide scale factor calculation module 404 receives the FP frequency samples 422 from the PQMF filter bank 402 and calculates scale factors used to store the FP frequency values 422. To reduce the required number of bits for storing the FP frequency samples 422 in the compressed frame produced by the system 400, the module 404 determines a block-wide maximum scale factor 424 for each of the three blocks of 12 samples of a particular frequency band. The 12 samples of a respective block for a particular band, as scaled by the block-wide scale factor, can be stored using the block-wide scale factor, which functions as a single common exponent. The module 404 performs determination of block-wide scale factors 424 independently for each of the up to 32 bands, resulting in a maximum of 96 scale factors 424 per frame. The scale factors 424 are one of the parameters used by the scaling and quantization module 412, described below, to quantize the mantissas of the FP frequency samples 422 in the compressed frame. (FP frequency samples as stored in a compressed frame in an encoded bitstream are represented by a mantissa and a scale factor).

A scale factor compression module 408, which receives the block-wide scale factors 424 from the module 404, further saves bits in the compressed frame by determining the difference of the three scale factors 424 for a particular frequency band in a frame and classifying the difference into one of 8 transmission patterns. Transmission patterns are referred to as scale factor select information (scfsi 428) and are used to compress the three scale factors 424 for respective frequency bands. For some patterns, depending on the relative difference between the three scale factors for a particular band, the value of one or two of the three scale factors is set equal to that of a third scale factor. Thus the quantization performed by the scaling and quantization module 412 is influenced by the selected transmission pattern 428.

A Psycho-Acoustic Model (PAM) module 406 receives the FP frequency samples 422 from the PQMF filter bank 402 as well as the PCM samples 420 and determines a Signal-To-Mask Ratio (SMR) 426 according to a model of the human hearing system. In some embodiments, the PAM module 406 performs a fast-Fourier transform (FFT) of the source PCM samples 420 as part of the determination of the SMR ratio 426. Accordingly, depending on the method used, application of the PAM is highly computationally expensive. The resulting SMR 426 is provided to the bit allocation module 410 and bitstream formatting module 414, described below, and is used in the bit allocation process to determine which frequency bands require more bits in comparison to others to avoid artifacts.

A bit allocation module 410 receives the transmission pattern 428 from the scale factor compression module 408 and the SMR 426 from the PAM module 406 and produces bit allocation information 430. The module 410 performs an iterative bit allocation process, operating across frequency bands and channels, to assign bits to frequency bands depending on a Mask-To-Noise ratio (MNR) defined as MNR [band]=SNR[band]−SMR[band], where SNR is provided by a fixed table determining the importance of each band, and SMR 426 is the result of the psycho-acoustic model calculation performed by the PAM module 406. Bands with the current minimum MNR receive more bits first, by relaxing the quantization for the band (initially, the quantization is set to "maximum" for all bands, which corresponds to no information being stored at all). When a band is selected to receive bits, the scale factor select information 428 is used to determine the fixed amount of bits required to store the scale factors for this band. The bit allocation process can require a significant number of iterations to complete; it ends when no more bits are available in the compressed target frame of the encoded bitstream 434. In general, the number of bits available for allocation depends on the selected target bit rate at which the encoded bitstream 434 is to be transmitted.

A scaling and quantization module 412 receives the FP frequency samples 422 from the module 402, the block-wide scale factors 424 from the module 404, and the bit allocation information 430 from the module 410. The scaling and quantization module 412 scales the mantissas of the FP frequency samples 422 of each frequency band according to the block-wide scale factors 424 and quantizes the mantissas according to the bit allocation information 430.

Quantized mantissas 432 from the scaling and quantization module 412 are provided to a bitstream formatting module 414 along with the SMR 426 from the PAM module 406, based on which the module 414 generates compressed target frames of the encoded bitstream 434. Generating a target frame includes storing a frame header, storing the bit allocation information 430, storing scale factors 424, storing the quantized mantissas 432 for the FP frequency samples 422 as scaled by the scale factors 424, and adding stuffing bits. To store the frame header, 32 frame header bits, plus optionally an additional 16 bits for cyclic redundancy check (CRC), are written to the compressed target frame. To store the bit allocation information, the numbers of bits required for the mantissas of the FP frequency samples 422 are stored as indices into a table, to save bits. Scale factors 424 are stored according to the transmission pattern (scfsi 428) determined by the module 408. Depending on the selected scfsi 428 for a frequency band, either three, two, or just one scale factor(s) are stored for the band. The scale factor(s) are stored as indices into a table of scale factors. Stuffing bits are added if the bit allocation cannot completely fill the target frame.

In the case of a stereo source with two channels, the encoding process performed by the system 400 is executed independently for each channel, and the bitstream formatting module 434 combines the data for both channels and writes the data to respective channels of the encoded bitstream 434. In the case of a mono source with a single channel, the encoding process encodes the data for the single channel and writes the encoded data to the encoded bitstream 434. In the case of "joint stereo mode," the encoding process creates two channels of encoded FP frequency samples for frequency bands below or equal to a specified (e.g., predefined) limit, but only one channel of encoded FP frequency samples for all frequency bands above the specified limit. In joint stereo mode, the encoder thus effectively operates as a single-channel (i.e., mono) encoder for bands above the specified limit, and as a stereo encoder for bands below or equal to the specified limit.

Although FIG. 4A shows the encoding system 400 as a number of discrete modules, FIG. 4A is intended more as a functional description of the various features which may be present in an encoder rather than as a structural schematic of an encoder. In practice, and as recognized by those of ordinary skill in the art, modules shown separately in FIG. 4A could be combined and some modules could be separated into multiple modules. In some embodiments, each of the above-identified modules 402, 404, 406, 408, 410, 412, and 414 corresponds to a set of instructions for performing a function described above. These sets of instructions need not be implemented as separate software programs, procedures, or modules, and thus various subsets of these modules may be combined or otherwise re-arranged in various embodiments. Alternatively, one or more of the above-identified modules 402, 404, 406, 408, 410, 412, and 414 may be implemented in hardware.

In the video game system 200, it is desirable to be able to mix multiple audio source streams in real time. For example, continuous (e.g., present over an extended period of time) background music may be mixed with one or more discrete sound effects generated based on a current state of a video game (e.g., in response to a user input), such that the background music will continue to play while the one or more sound effects are played. Combining PCM samples for the multiple audio source streams and then using the system 400 to encode the combined PCM samples is computationally inefficient because the encoding performed by the system 400 is computationally intensive. In particular, PQMF filtering, scale factor calculation, application of a PAM, and bit allocation can be highly computationally efficient. Accordingly, it is desirable to encode audio source streams such that the encoded streams can be mixed in real time without performing one or more of these operations.

In some embodiments, independent audio source streams are mixed by performing PQMF filtering off-line and then adding respective FP frequency samples of respective sources in real-time and dividing the results by a constant value, or adjusting the scale factors accordingly, to avoid clipping. For example, two sources of audio (e.g., two stereo sources with two channels (L+R) each) may be mixed by performing PQMF filtering of each source (e.g., by PQMF-filtering each of the two channels of each source) offline and then adding respective FP frequency samples of the two sources in real time. Specifically, each of the twelve FP frequency samples in each of the 3 blocks for a particular frequency band in a frame of the first source is added to a corresponding FP frequency sample at a corresponding location in a corresponding block for the particular frequency band in a corresponding frame of the second source. To avoid clipping, the resulting combined FP frequency samples are divided by a constant value (e.g., 2 or $\sqrt{2}$) or their scale factors are adjusted accordingly. Real-time mixing is then performed by executing the other steps of the encoding process (e.g., as performed by the modules 404, 406, 408, 410, 412, and 414, FIG. 4A) for the combined FP frequency samples. In some embodiments, because division of the combined FP frequency samples by the constant value leads to the volume level of the mixed audio being lower than that of unmixed audio, unmixed audio is scaled down by the same amount to achieve an even volume level.

In some embodiments, in addition to performing PQMF filtering off-line, the audio source streams are further encoded off-line by applying a fixed PAM to the FP frequency samples produced by the PQMF filtering and by precalculating scale factors. Furthermore, in some embodiments the scale factors are calculated such that each of the three blocks for a particular frequency band in a frame has the same scale factor (i.e., the difference between the scale factors of the three blocks of a frequency band is zero), resulting in a constant transmission pattern (0x111) for each frequency band in each frame. The scale factors thus are frame-wide scale factors, as opposed to the block-wide scale factors 424 generated in the system 400 (FIG. 4A). The combination of a fixed PAM and frame-wide scale factors results in a constant bit allocation.

The fixed PAM corresponds to a table of SMR values (i.e., an SMR table) to be applied to FP frequency samples of respective frequency bands. Use of a fixed PAM eliminates the need to re-apply a full PAM to each frame in a stream. The SMR values may be determined empirically by performing multiple runs of a SMR detection algorithm (e.g., implemented in accordance with the MPEG-1 Layer II audio specification) using different kinds of audio material (e.g., various audio materials resembling the audio material in a video game) and averaging the results. For example, the following SMR table was found to provide acceptable results, with barely noticeable artifacts in the higher frequency bands: {30, 17, 16, 10, 3, 12, 8, 2.5, 5, 5, 6, 6, 5, 6, 10, 6, −4, −10, −21, −30, −42, −55, −68, −75, −75, −75, −75, −75, −91, −107, −110, −108}

The SMR values in this table correspond to respective frequency bands, sorted by increasing frequency, and are used for each of the two channels in a stereo source stream. Thus, in this example, the frequencies in the lower half of the spectrum get more weight, against which the weights for the upper frequencies are traded off.

Figure 4B:
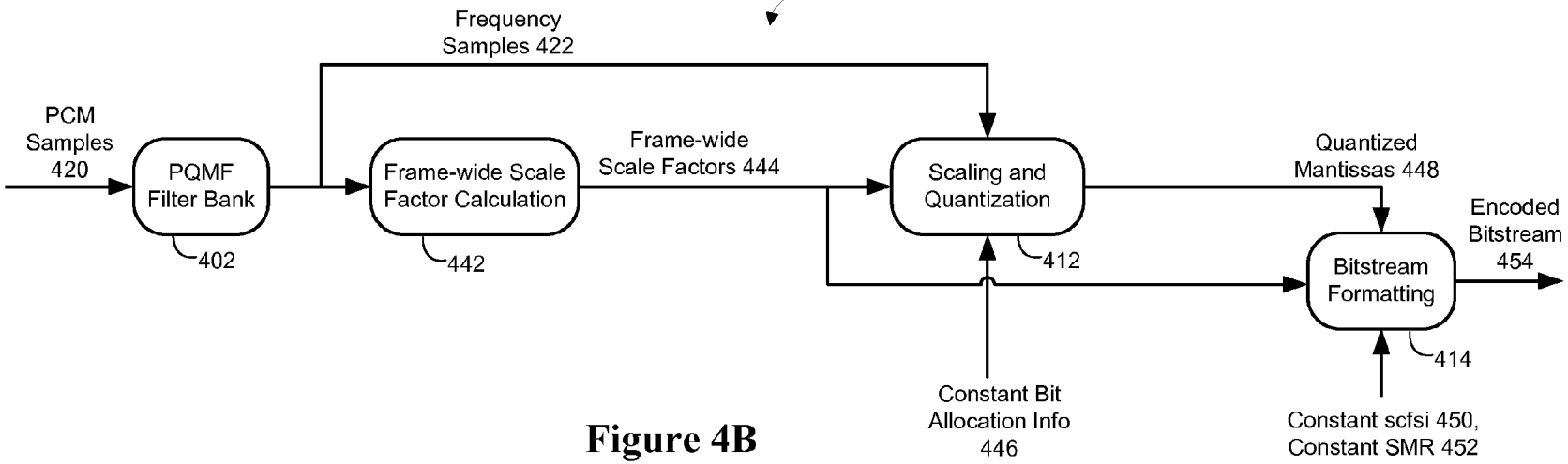

FIG. 4B is a block diagram of a system 440 for performing offline encoding of frames of audio data in an audio source stream using a fixed PAM and frame-wide scale factors in accordance with some embodiments. A frame-wide scale factor calculation module 442 receives FP frequency samples 422 from the PQMF filter bank 402, which operates as described with regard to FIG. 4A. The frame-wide scale factor calculation module 442 determines a frame-wide maximum scale factor 444 for the 36 FP frequency samples 422 in a particular frequency band of a frame. Because all three blocks for each frequency band have the same scale factor, the transmission pattern is a constant, known value (e.g., pattern 0x111). Accordingly, the scale factor compression module 408 of the system 400 (FIG. 4A) is omitted from the system 440.

Because the transmission pattern is constant and the SMR provided by the fixed PAM is constant, the bit allocation information 446 is also constant, allowing the bit allocation module 410 of the system 400 (FIG. 4A) to be omitted from the system 440. The constant bit allocation information 446, frame-wide scale factors 444, and FP frequency samples 422 are provided to the scaling and quantization module 412, which produces quantized mantissas 448. The quantized mantissas 448 are provided to the bitstream formatting module 414 along with the constant transmission pattern 450 and constant SMR 452. The bitstream formatting module 414 produces an encoded bitstream 454, which is stored for subsequent real-time mixing with other encoded bitstreams 454 generated from other audio source streams. In some embodiments, encoded bitstreams 454 are stored as pre-encoded audio signals 257 in the memory 222 of a video game system 200 (FIG. 2).

In some embodiments, scale factors (e.g., block-wide scale factors 424, FIG. 4A, or frame-wide scale factors 444, FIG. 4B) are stored as indices into a table of scale factors. For example, the MPEG-1 Layer II standard uses 6-bit binary indices to reference 64 distinct possible scale factors. Thus, in some embodiments the block-wide scale factors 424 (FIG. 4A) and/or frame-wide scale factors 444 (FIG. 4B) are stored as 6-bit indices into a table of 64 distinct scale values (e.g., as specified by the MPEG-1 Layer II standard). 6-bit indices provide 2 dB resolution, with one step in the scale factor corresponding to 2 dB. In some embodiments, however, additional bits beyond the specified 6 bits are used to store higher-resolution scale factors for encoded bitstreams. This use of higher-resolution scale factors improves the sound quality resulting from mixing encoded bitstreams.

Figure 4C:
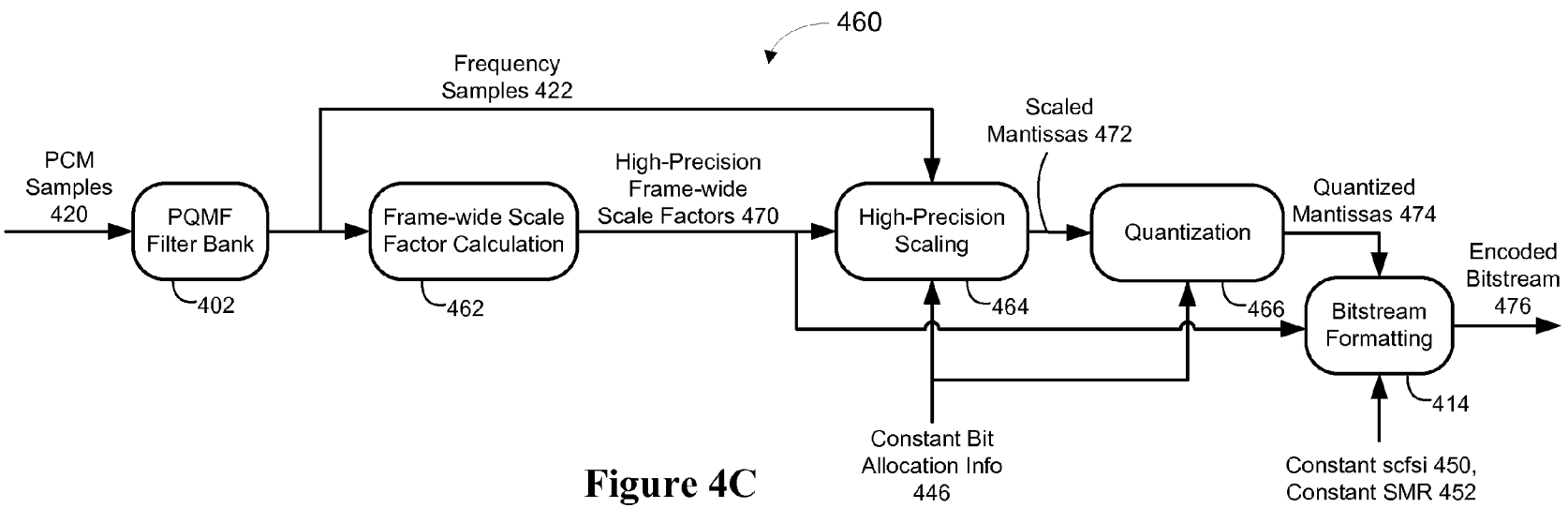

FIG. 4C is a block diagram of a system 460 for performing offline encoding of frames of audio data in accordance with some embodiments. Like the system 440 (FIG. 4B), the system 460 uses a fixed PAM and frame-wide scale factors. However, the system 460 uses high-precision frame-wide scale factors 470, as determined by the frame-wide scale factor calculation module 462. In this context, "high-precision" refers to higher than 6-bit resolution for the scale factor indices. The system 460 also separates the scaling and quantization operations performed by the module 412 in the system 440 (FIG. 4B). In the system 460, a high-precision scaling module 464 generates scaled mantissas 472, which then are quantized by the quantization module 466. This separation allows the scaled mantissas 472 to be stored before quantization. The quantization module 466 provides quantized mantissas 474 to the bitstream formatting module 414, which generates an encoded bitstream 476.

In some embodiments, 8-bit binary indices are used to store the high-precision frame-wide scale factors 470. 8-bit indices provide 0.5 dB resolution, with one step in the scale factor corresponding to 0.5 dB. For example, the available high-precision frame-wide scale factors 470 may have values determined by the formula $$\text{HighprecScaleFactor}[i]=2^{1-i/12},\ \text{for } i=0 \text{ to } 255, \quad (1)$$

where i is an integer that serves as an index. The scale factors as determined by this formula may be stored in a look-up table indexed by i. Use of 8-bit indices allows mantissas to be virtually shifted by 1/12 of a bit, as opposed to 1/4 of a bit for 6-bit indices.

In some embodiments, scaled mantissas (e.g., 472) are stored using a single byte each. In some embodiments, scaled mantissas (e.g., 472) are stored using 16 bits each.

In some embodiments, encoded bitstreams 476 are stored as pre-encoded audio signals 257 in the memory 222 of a video game system 200 (FIG. 2).

FIGS. 4B and 4C, like FIG. 4A, are intended more as functional descriptions of the various features which may be present in encoders (e.g., in an audio signal pre-encoder 264, FIG. 2) rather than as structural schematics of encoders. In practice, and as recognized by those of ordinary skill in the art, modules shown separately in FIGS. 4B and 4C could be combined and some modules could be separated into multiple modules. In some embodiments, each of the above-identified modules 402, 442, 412, and 414 (FIG. 4B) or 402, 462, 464, 466, and 414 (FIG. 4C) corresponds to a set of instructions for performing a function described above. These sets of instructions need not be implemented as separate software programs, procedures, or modules, and thus various subsets of these modules may be combined or otherwise re-arranged in various embodiments. Alternatively, one or more of the above-identified modules 402, 442, 412, and 414 (FIG. 4B) or 402, 462, 464, 466, and 414 (FIG. 4C) may be implemented in hardware.

To mix multiple encoded bitstreams (e.g., multiple encoded bitstreams 454 (FIG. 4B) or 476 (FIG. 4C)) in real time, respective FP frequency samples in the encoded bitstreams are combined. For example, to mix first and second encoded bitstreams, each of the 36 FP frequency samples of a particular frequency band in a frame of the first encoded bitstream is combined with a respective FP frequency sample of the same frequency band in a corresponding frame of the second encoded bitstream. In some embodiments, combining the FP frequency samples includes calculating an adjusted scale factor to scale FP frequency samples in a particular frequency band of respective frames of the first and second encoded bitstreams. In some embodiments, the adjusted scale factor is calculated as a function of the difference between the frame-wide scale factors of the respective frames of the first and second encoded bitstreams for a particular frequency band. For example, the adjusted scale factor may be calculated by subtracting the larger of the two scale factors from the smaller of the two scale factors and, based on the difference, adding an offset to the larger of the two scale factors, where the offset is a monotonically decreasing (i.e., never increasing) function of the difference between the larger and smaller of the two scale factors.

As discussed above, the scale factors may be represented by indices into a table of scale factors. As can be seen in Equation (1), lower indices i correspond to larger scale factors, and vice versa (i.e., the higher the index i, the smaller the scale factor). Thus, to calculate the index for the adjusted scale factor, the difference between the scale factors of the respective frames of the first and second encoded bitstreams for a particular frequency band is determined. Based on the difference, an offset is subtracted from the lower of the two indices, wherein the offset is a monotonically decreasing (i.e., never increasing) function of the difference.

Figure 5:
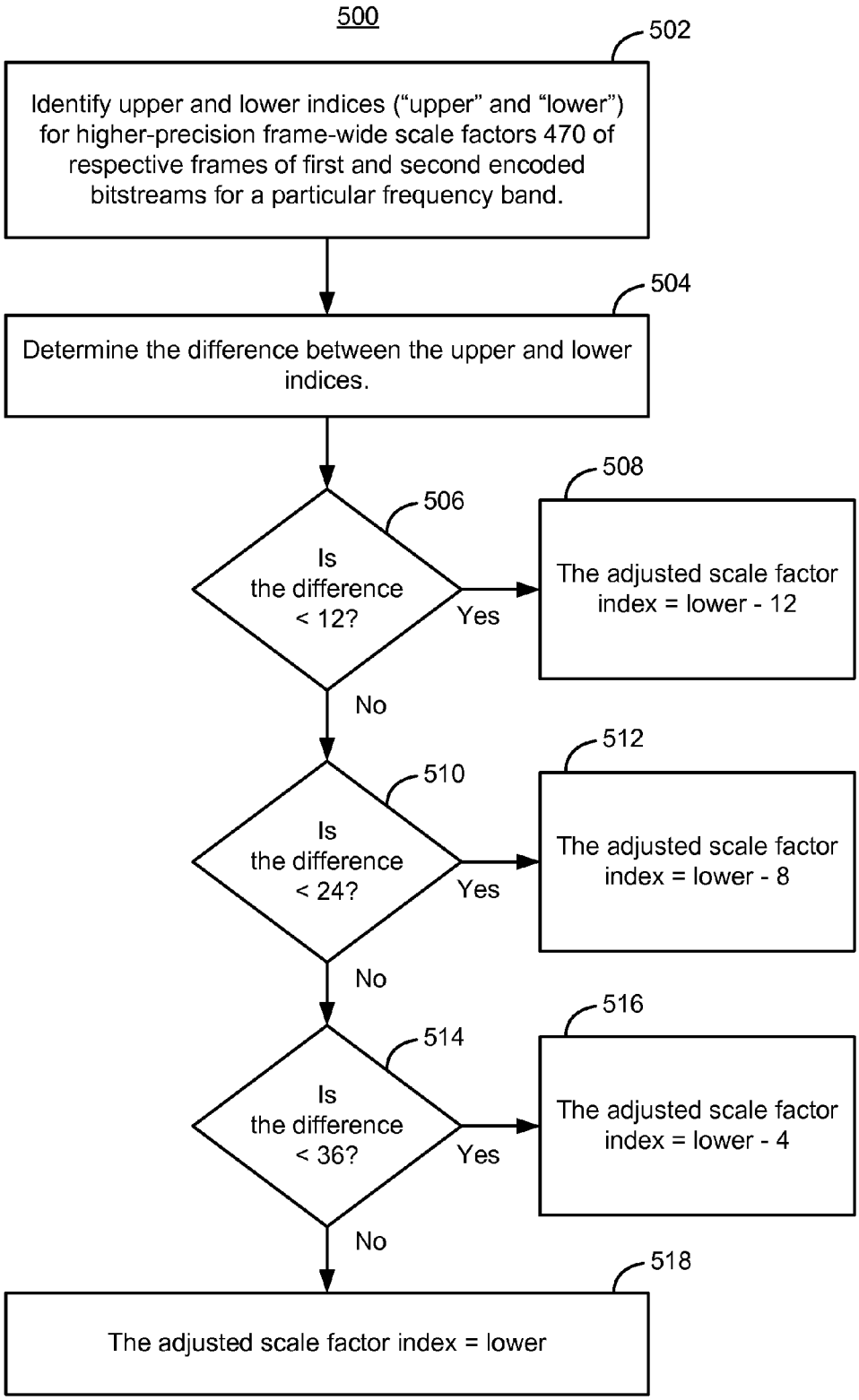
FIG. 5 is a flow diagram of a process of determining an adjusted scale factor index in accordance with some embodiments.

FIG. 5 is a flow diagram of a process 500 of mixing high-precision frame-wide scale factors 470 of respective frames of first and second encoded bitstreams for a particular frequency band by determining an adjusted scale factor index based on indices for the high-precision frame-wide scale factors 470 of the first and second encoded bitstreams 476 in accordance with some embodiments. In some embodiments, the process 500 is performed by an audio frame mixer (e.g., mixer 255, FIG. 2). In the process 500, the upper and lower (i.e., larger and smaller) indices for the high-precision frame-wide scale factors 470 of respective frames of the first and second encoded bitstreams for a particular frequency band are identified (502) and the difference between the upper and lower indices is determined (504). If the difference between the two indices is less than 12 (506-Yes), then the adjusted scale factor is set equal to the lower index minus 12 (508). If not (506-No), and if the difference between the two indices is less than 24 (510-Yes), then the adjusted scale factor is set equal to the lower index minus 8 (512). If not (510-No), and if the difference between the two indices is less than 36 (514-Yes), then the adjusted scale factor is set equal to the lower index minus 4 (516). Otherwise, the adjusted scale factor is set equal to the lower index (518). The offsets in the process 500 are thus seen to be a monotonically decreasing (i.e., never increasing) function of the difference between the upper and lower indices: as the difference increases, the offsets decrease monotonically from 12 (508) to 8 (512) to 4 (516) to zero (518). These offset values and their corresponding ranges of differences are merely examples of possible offsets; other values may be used if they are empirically determined to provide acceptable sound quality. A similar process to the process 500 may be implemented using 6-bit resolution scale factor indices.

Once the adjusted scale factor has been determined, respective FP scale factors in corresponding frames and frequency bands of the first and second encoded bitstreams (e.g., bitstreams 454 (FIG. 4B) or 476 (FIG. 4C)) are scaled by the adjusted scale factor and then added together according to the following formula:

$$\text{Combined FP Freq. Sample}=(FP1*SF1)/Adj.SF+(FP2*SF2)/Adj.SF \quad (2)$$

where FP1 and FP2 are respective unscaled FP frequency samples 422 reconstructed from the first and second encoded bitstreams, SF1 and SF2 are their original scale factors (e.g., 444 (FIG. 4B) or 470 (FIG. 4C)), and Adj.SF is the adjusted scale factor (e.g., calculated according to the process 500, FIG. 5). Where the scale factors SF1, SF2, and Adj.SF are stored as indices into a table of scale factors HighprecScaleFactor[i], respective FP scale factors are combined according to the following formula, which is equivalent to Equation (2):

$$\text{Combined FP Freq. Sample}=FP1*HighprecScaleFactor[Adj.idx-SF1.idx]+FP2*HighprecScaleFactor[Adj.idx-SF2.idx] \quad (3)$$

where Adj.idx is the index corresponding to Adj.SF, SF1.idx is the index corresponding to SF1, and SF2.idx is the index corresponding to SF2.

In some embodiments, if the absolute value of "Combined FP Freq. Sample" exceeds a predefined limit, it is adjusted to prevent clipping. For example, if "Combined FP Freq. Sample" is greater than a predefined limit (e.g., 32,767), it is set equal to the limit (e.g., 32,767). Similarly, if "Combined FP Freq. Sample" is less than a predefined limit (e.g., −32,768), it is set equal to the limit (e.g., −32,768). The boundaries [−32678, 32768] result from shifting the FP frequency samples from an original floating point range of [−1.0, 1.0] by multiplying by 32,768. Shifting the FP frequency samples into the 16-bit integer range uses less storage for the pre-encoded data and allows for faster integer operations during real time stream merging.

The Combined FP Freq. Samples are written to an output bitstream, which is provided to an appropriate system for playback. For example, the output bitstream may be transmitted to a STB 300 where it is decoded and provided to speakers for playback.

An output bitstream may include mixed audio data from multiple sources at some times and audio data from only a single source at other times. In some embodiments, encoded bitstreams include real-time-mixable data as well as standard MPEG-1 Layer II data that may be provided to the output bitstream when mixing is not being performed.

Figure 6:
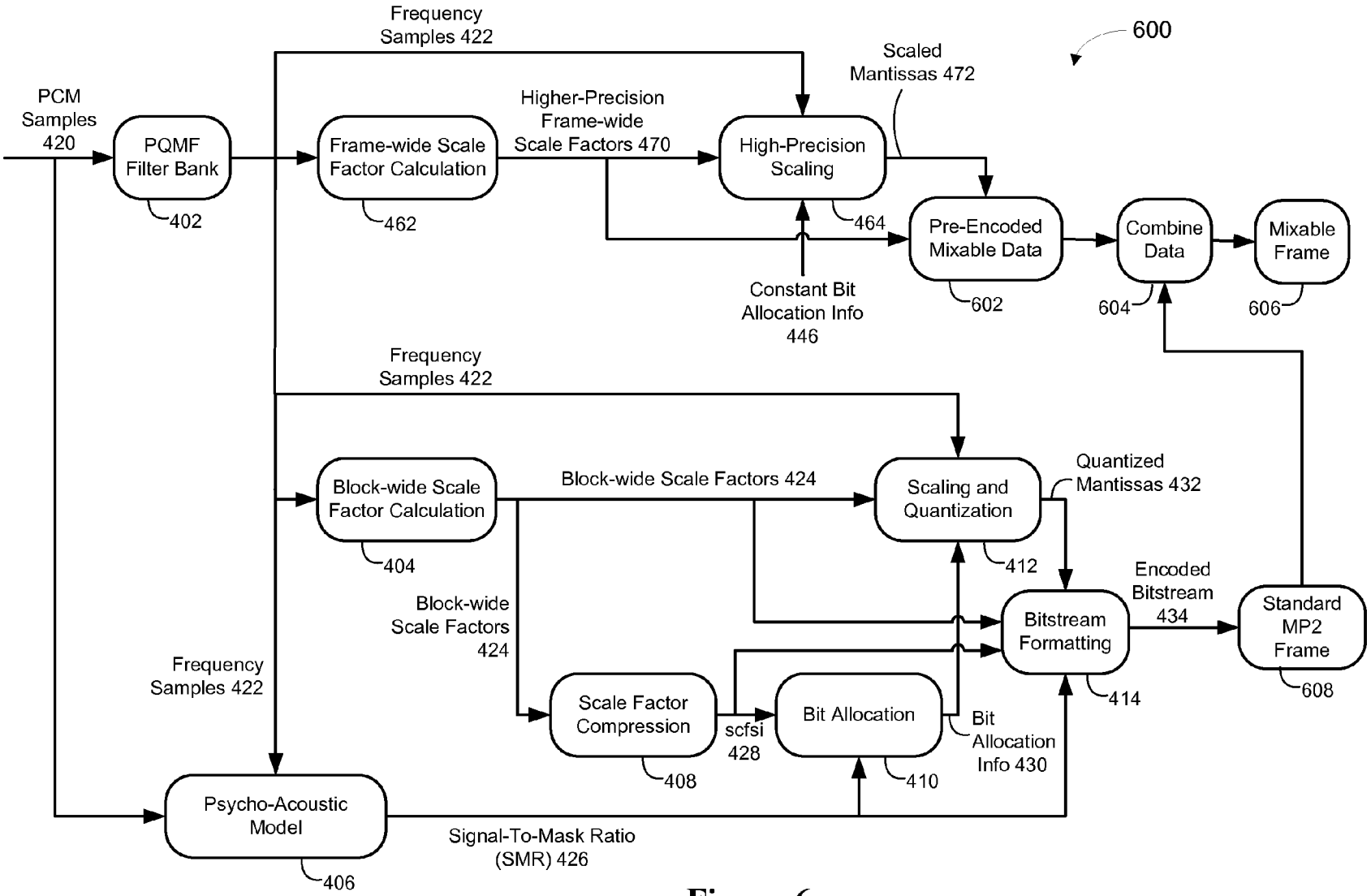
FIG. 6 is a block diagram of a system for generating mixable frames that include both real-time mixable audio data and standard MPEG-1 Layer II audio data in accordance with some embodiments.

FIG. 6 is a block diagram of a system 600 that combines elements of the systems 400 (FIG. 4A) and 460 (FIG. 6) to generate mixable frames 606 that include both real-time mixable audio data as generated by the system 460 and standard MPEG-1 Layer II audio data in accordance with some embodiments. The real-time mixer (e.g., audio frame merger 255, FIG. 2) selects the standard MPEG-1 Layer II audio data when only a single audio source (e.g., background music in a video game) is specified for playback and selects the real-time mixable audio data when multiple audio sources (e.g., background music and a sound effect) are specified to be mixed for playback. In the system 600, the scaled mantissas 472 generated by the high-precision scaling module 464 are stored as pre-encoded mixable data by the module 602. A combine data module 604 combines the pre-encoded mixable data with the standard MPEG-1 Layer II frame generated by the bitstream formatting module 414 to produce a mixable frame 606 that includes both the real-time mixable audio data and the standard MPEG-1 Layer II audio data.

For stereo mode, the system 600 processes each channel separately, resulting in two sets of data that are stored in separate channels of the mixable frames 606. For joint stereo mode, the system 600 produces three sets of data that are stored separately in the mixable frames 606.

Figure 7:
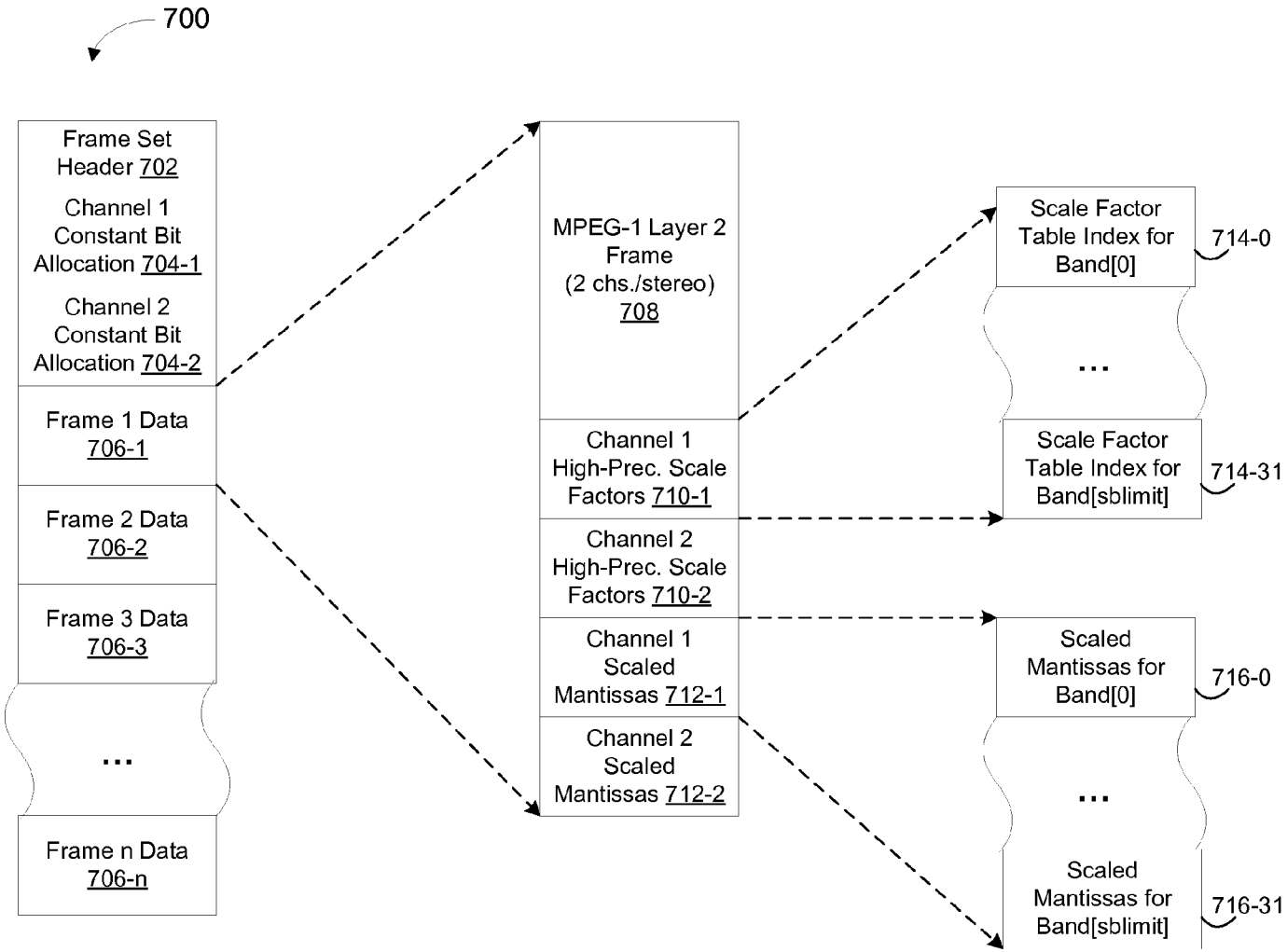
FIG. 7 illustrates a data structure of an audio frame set in accordance with some embodiments.

In some embodiments, mixable frames 606 are stored as audio frame sets. FIG. 7 illustrates a data structure of an audio frame set 700 generated by the system 600 in accordance with some embodiments. In the example of FIG. 7, the frame set 700 is generated from a stereo source stream and thus has two channels. The frame set 700 includes a header 702, constant bit allocation information 704-1 and 704-2 (e.g., corresponding to constant bit allocation information 446, FIG. 6) for each of the two channels, and frames 706-1 through **706-*n*, where n is an integer corresponding to the number of frames in the set 700. The frames 706 each include a standard MPEG-1 Layer II frame 708 (e.g., corresponding to frame 608, FIG. 6) with two channels, high precision frame-wide scale factors 710-1 and 710-2 (e.g., corresponding to scale factors 470) for each of the two channels, and scaled mantissas 712-1 and 712-2 (e.g., corresponding to scaled mantissas 472) for each of the two channels. The high precision scale factors 710 are stored as scale factor table indices 714-0 through 714-31 (for the example of 32 frequency bands, in which case sblimit=31), each of which correspond to a particular frequency band. The scaled mantissas 712 include scaled mantissas 716-0 through 716-31** (for the example of 32 frequency bands, in which case sblimit=31), each corresponding to a particular frequency band.

Figure 8:
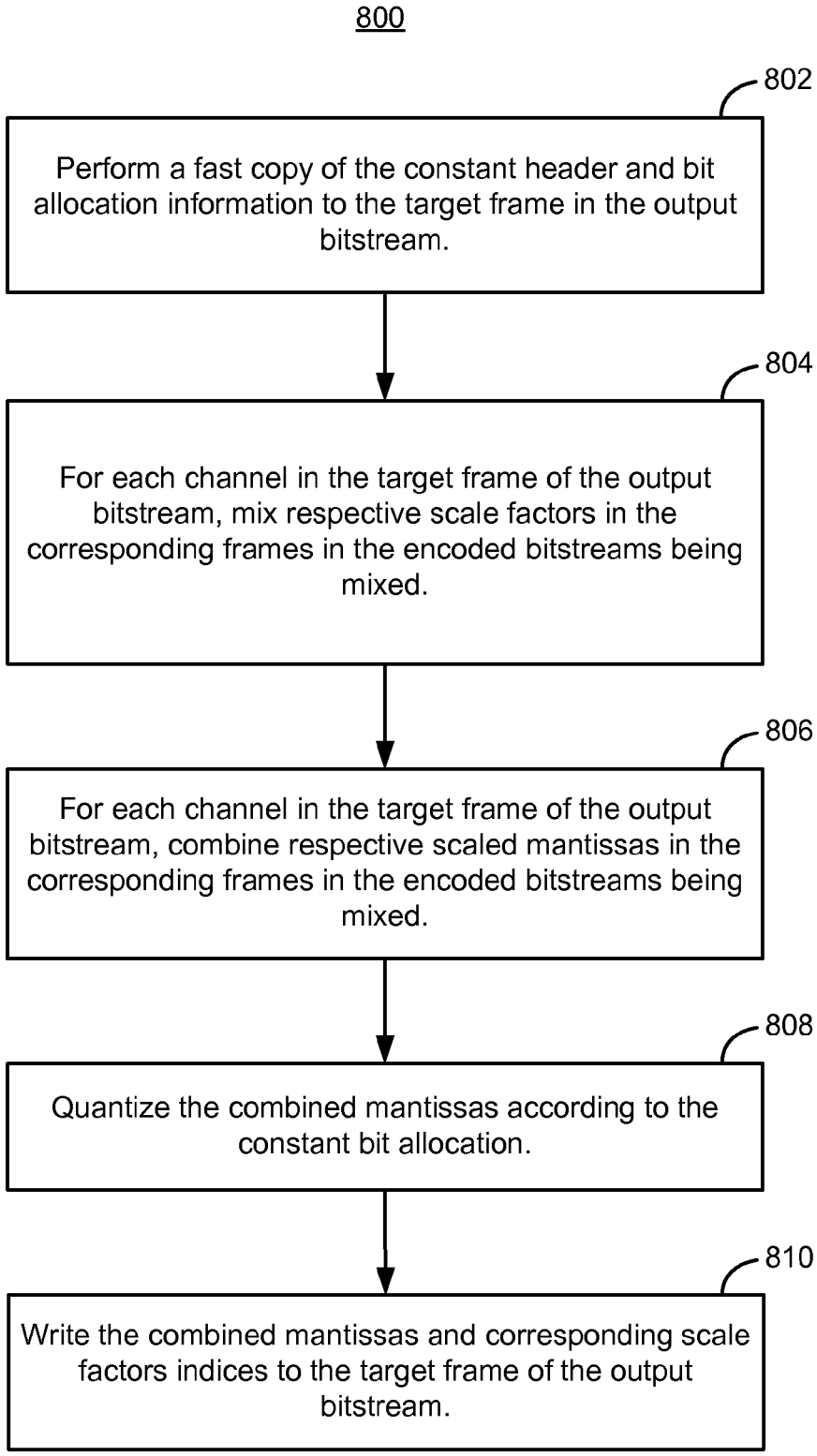
FIG. 8 is a flow diagram illustrating a process of real-time audio frame mixing, also referred to as audio frame stitching, in accordance with some embodiments.

FIG. 8 is a flow diagram illustrating a process 800 of real-time audio frame mixing, also referred to as audio frame stitching, in accordance with some embodiments. The process 800 is performed by an audio frame merger (e.g., audio frame merger 255, FIG. 2) and generates an output bitstream for transmission to a client device (e.g., to STB 300, FIG. 3) for playback.

In the process 800, a fast copy of the constant header and bit allocation information to the target frame in the output bitstream is performed (802). Because the bits of the frame header do not change (i.e., are constant from frame to frame) once they have been set at the beginning of the real-time mixing, and because the constant bit allocation immediately follows the frame header, in some embodiments both the frame header bits and the constant bit allocation are stored in a constant bit array and copied to the beginning of each frame in the output bitstream in operation 802.

For each channel in the target frame of the output bitstream, respective scale factors in the corresponding frames of the encoded bitstreams are mixed (804). For example, an adjusted scale factor is calculated in accordance with the process 500 (FIG. 5).

For each channel in the target frame of the output bitstream, respective scaled mantissas in the corresponding frames in the encoded bitstreams being mixed are combined (806). The mantissas are combined, for example, in accordance with Equations (2) and (3). The combined mantissas are quantized (808) according to the constant bit allocation. The combined mantissas and corresponding adjusted scale factors are written (810) to the target frame of the output bitstream.

The operations 804 and 806 may be repeated an arbitrary number of times to mix in additional encoded bitstreams corresponding to additional sources.

The process 800 may include calculation of a CRC. Alternatively, the CRC is omitted to save CPU time.

If two stereo encoded bitstreams corresponding to two independent stereo sources are mixed, their left channels are mixed into the left channel of the output bitstream and their right channels are mixed into the right channel of the output bitstream. If a stereo encoded bitstream corresponding to a stereo source (e.g., to background music) is mixed with a mono encoded bitstream corresponding to a mono source (e.g., to a sound effect), a pseudo-center channel may be simulated by mixing the mono encoded bitstream with both the left and right channels of the stereo encoded bitstream, such that the left channel of the output bitstream is a mix of the mono encoded bitstream and the left channel of the stereo encoded bitstream, and the right channel of the output bitstream is a mix of the mono encoded bitstream and the right channel of the stereo encoded bitstream. Alternatively, a mono encoded bitstream may be mixed with only one channel of a stereo encoded bitstream, such that one channel of the output bitstream is a mix of the mono encoded bitstream and one channel of the stereo encoded bitstream and the other channel of the output bitstream only includes audio data from the other channel of the stereo encoded bitstream.

Attention is now directed to operation of the audio frame merger 255 (FIG. 2) in different scenarios.

If no sources are to be played, the audio frame merger 255 copies a standard MPEG-1 Layer II frame containing silence to the data location of the target frame in the output bitstream.

If a single source is to be played, the audio frame merger 255 copies the standard MPEG-1 Layer II frame 608/708 (FIGS. 6 and 7) for the source to the data location of the target frame in the output bitstream. The copied frame 608/708 may be in mono, stereo, or joint stereo mode.

If two or more sources are to be mixed, the scaled mantissas and corresponding scale factors (e.g., frame-wide scale factors 444, FIG. 4B, or high-precision frame-wide scale factors 470, FIG. 4C) from the encoded bitstream for one of the sources are copied to separate intermediate stores for each channel. The values in the intermediate stores are then mixed with respective values from the encoded bitstream of a second source (e.g., in accordance with the process 800, FIG. 8) and the results are written back to the intermediate stores. This process may be repeated to mix in data from additional sources.

In some embodiments, if the target frame has two channels but there is only source data for one channel, the mixer automatically copies scale factors and scaled mantissas comprising silence to the corresponding intermediate store of the other channel.

Once the mixing is complete, the target frame of the output bitstream is constructed based on the pre-computed frame header, the constant bit allocation, and the data in the intermediate stores. Where high-precision frame-wide scale factors are used, the scale factor indices are divided down to the standard 6-bit indices, which are written to the target frame. For example, if 8-bit high-precision frame-wide scale factor indices are used for the scale factors 470, the adjusted scale factor indices in the intermediate stores are divided by four before being written to the output bitstream. The mixed, scaled mantissas in the intermediate stores are quantized (e.g., in accordance with the MPEG-1 Layer II standard quantization algorithm) and written to the output bitstream.

Figure 9:
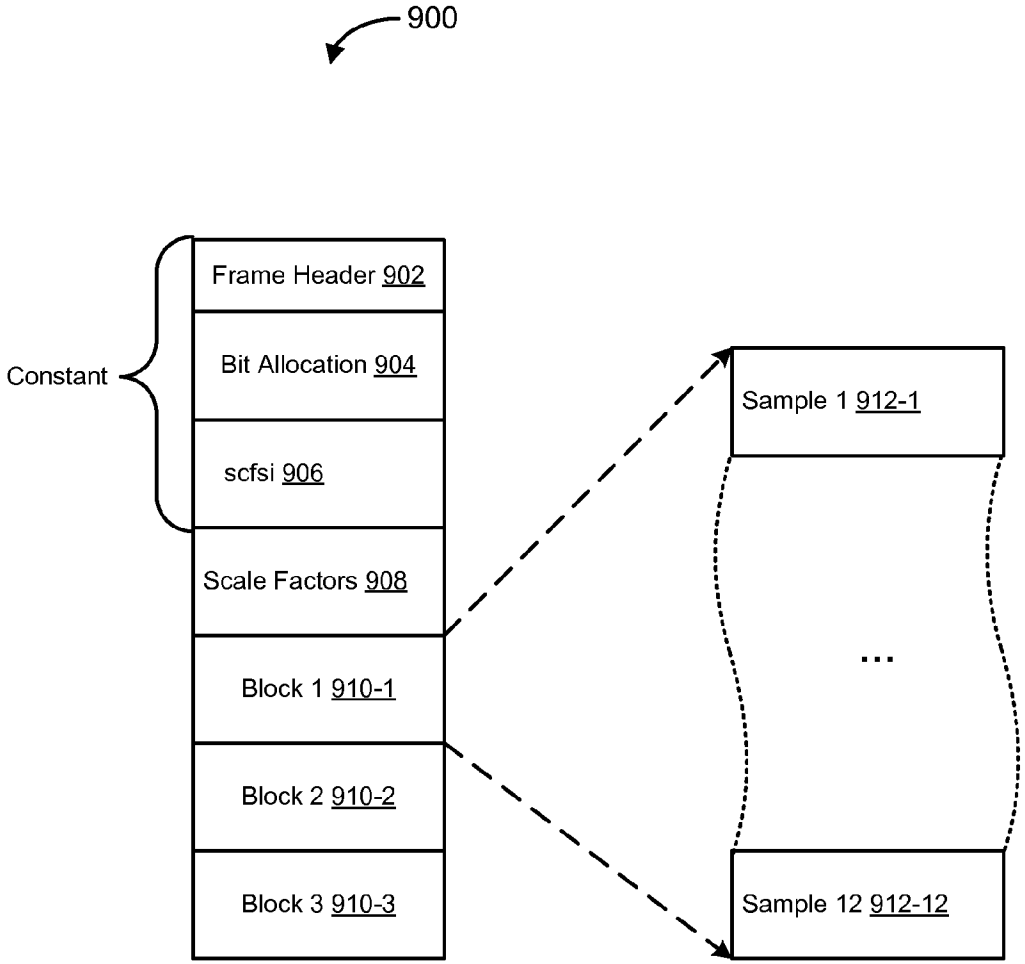
FIG. 9 illustrates a data structure of an audio frame in an output bitstream in accordance with some embodiments.

FIG. 9 illustrates a data structure of an audio frame 900 in an output bitstream generated by the process 800 in accordance with some embodiments. The frame header 902, bit allocation information 904, and transmission pattern 906 are constant in value. The frame 900 also includes scale factors 908 stored as indices (e.g., 6-bit indices) into a table of scale factors, and blocks 910-1, 910-2, and 910-3. Each block 910 includes frequency sample mantissas 912-1 through 912-12 for each frequency band being used. One or more values 906, 908, and/or 912 may be absent. For example, a particular frequency band may be unused. In some embodiments, three consecutive mantissas 912 are compressed into a single code word in accordance with the MPEG-1 Layer II standard.

Figure 10A:
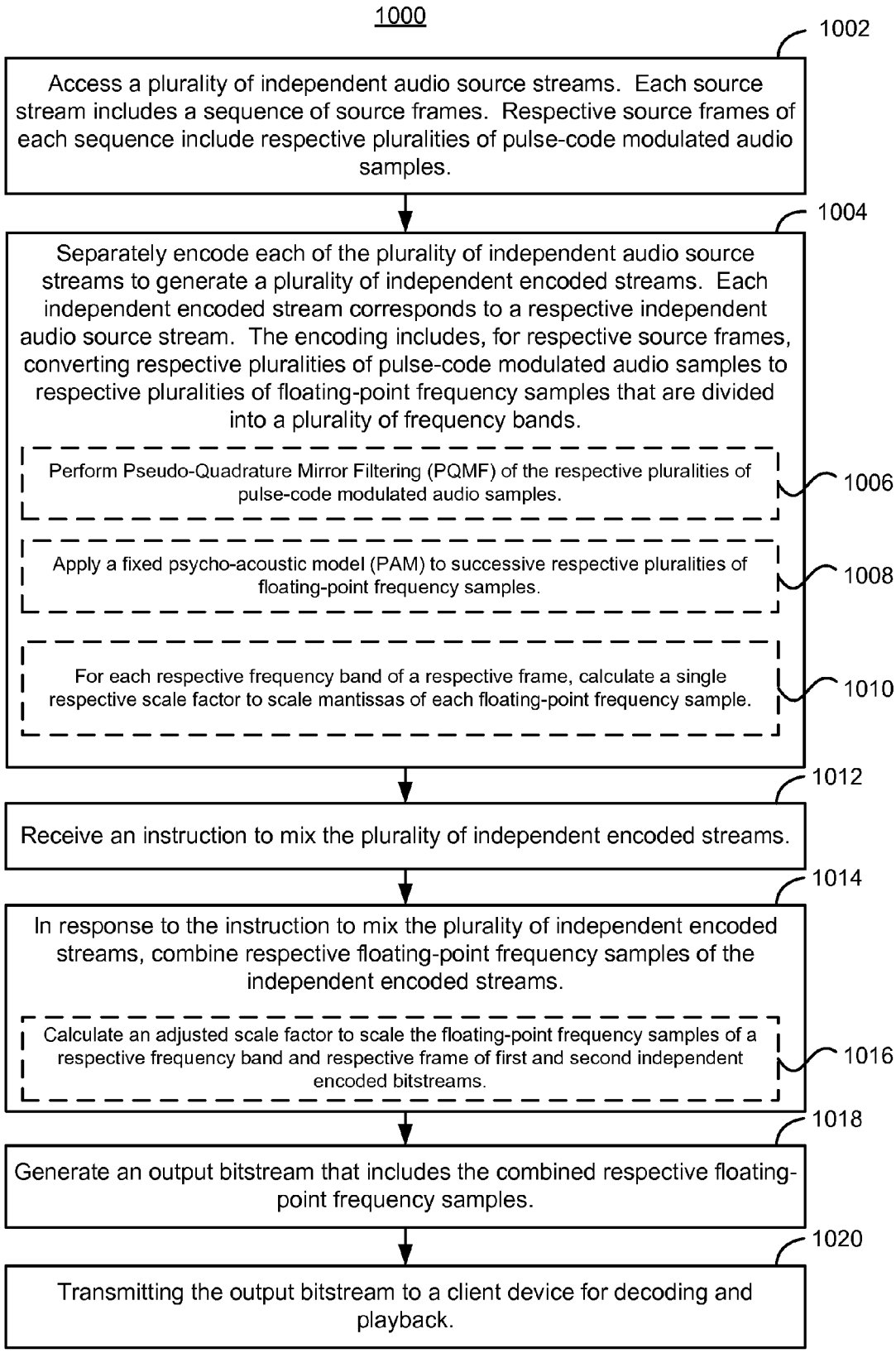
FIGS. 10A-10D are flow diagrams illustrating a process of encoding audio in accordance with some embodiments.

FIG. 10A is a flow diagram illustrating a process 1000 of encoding audio in accordance with some embodiments.

In the process 1000, a plurality of independent audio source streams is accessed (1002). Each source stream includes a sequence of source frames. Respective source frames of each sequence include respective pluralities of pulse-code modulated audio samples (e.g., PCM samples 420, FIGS. 4B-4C and 6).

Each of the plurality of independent audio source streams is separately encoded (1004) to generate a plurality of independent encoded streams (e.g., encoded bitstreams 454, FIG. 4B, or 476, FIG. 4C). Each independent encoded stream corresponds to a respective independent audio source stream. The encoding includes, for respective source frames, converting respective pluralities of pulse-code modulated audio samples (e.g., PCM samples 420, FIGS. 4B-4C) to respective pluralities of floating-point frequency samples (e.g., FP frequency samples 422, FIGS. 4B-4C and 6) that are divided into a plurality of frequency bands.

In some embodiments, a respective encoded stream generated from a respective source stream includes a sequence of encoded frames (e.g., frames 706, FIG. 7) that correspond to respective source frames in the respective source stream.

In some embodiments, converting the respective pluralities of pulse-code modulated audio samples to respective pluralities of floating-point frequency samples includes performing (1006) Pseudo-Quadrature Mirror Filtering (PQMF) of the respective pluralities of pulse-code modulated audio samples (e.g., using the PQMF filter bank 402, FIGS. 4B-4C).

In some embodiments, the encoding includes applying (1008) a fixed psycho-acoustic model (PAM) to successive respective pluralities of floating-point frequency samples. In some embodiments, the fixed PAM is implemented as a predefined table having a plurality of entries, wherein each entry corresponds to a signal-to-mask ratio (SMR) for a respective frequency band of the plurality of frequency bands.

In some embodiments, the encoding includes, for each respective frequency band of a respective frame, calculating (1010) a single respective scale factor (e.g., a frame-wide scale factor 444, FIG. 4B, or high-precision frame-wide scale factor 470, FIGS. 4C and 6) to scale mantissas of each floating-point frequency sample. The floating-point frequencies in the respective frequency band of the respective frame, as scaled by the single respective scale factor, thus share a single exponent corresponding to the single respective scale factor.

In some embodiments, successive encoded frames of the respective encoded stream each comprise three blocks. Each block stores twelve floating-point frequency samples per frequency band. For each of the successive encoded frames, the single respective scale factor in each respective frequency band scales each of the twelve floating-point frequency samples in each of the three blocks. In some embodiments, the encoding operation 1004 includes selecting a transmission pattern to indicate, for each respective frequency band of each of the successive encoded frames, that the single scale factor scales the mantissas in the three blocks.

An instruction is received (1012) to mix the plurality of independent encoded streams. For example, the instruction could specify the mixing of one or more sound effects with background music in a video game or the mixing of multiple sounds effects in a video game.

In response to the instruction to mix the plurality of independent encoded streams, respective floating-point frequency samples of the independent encoded streams are combined (1014).

In some embodiments, combining respective floating-point frequency samples includes mixing scale factors by calculating (1016) an adjusted scale factor (e.g., in accordance with operation 804 of the process 800, FIG. 8). The adjusted scale factor is used to scale the floating-point frequency samples of a respective frequency band and respective frame of first and second independent encoded bitstreams.

An output bitstream is generated (1018) that includes the combined respective floating-point frequency samples. In some embodiments, the output bitstream is generated in accordance with the process 800 (FIG. 8). The output bitstream is transmitted (1020) to a client device (e.g., STB 300, FIG. 3) for decoding and playback.

In some embodiments, respective frames of an independent audio source stream of the plurality of independent audio source streams are also encoded in accordance with the MPEG-1 Layer II standard (e.g., as described for the system 600, FIG. 6). An instruction is received to play audio associated only with the independent audio source stream. In response, an output bitstream is generated that includes the respective frames of the independent audio source stream as encoded in accordance with the MPEG-1 Layer II standard (e.g., frames 708, FIG. 7).

In some embodiments, first and second independent audio source streams of the plurality of independent audio source streams and corresponding first and second independent encoded streams of the plurality of independent encoded streams each include a left channel and a right channel. The combining operation 1014 includes mixing the left channels of the first and second independent encoded streams to generate a left channel of the output bitstream and mixing the right channels of first and second independent encoded streams to generate a right channel of the output bitstream.

In some embodiments, a first independent audio source stream and corresponding first independent encoded stream of the plurality of independent encoded streams each include a left channel and a right channel. A second independent encoded stream of the plurality of independent encoded streams and corresponding second independent encoded stream of the plurality of independent encoded streams each include a mono channel. The combining operation 1014 includes mixing the right channel of the first independent encoded stream with the mono channel of the second independent encoded stream to generate a right channel of the output bitstream and mixing the left channel of the first independent encoded stream with the mono channel of the second independent encoded stream to generate a left channel of the output bitstream. Alternatively, the combining operation includes mixing one channel (either left or right) of the first independent encoded stream with the mono channel of the second independent encoded stream to generate one channel of the output bitstream and copying the other channel (either right or left) of the first independent encoded stream to the other channel of the output bitstream.

In some embodiments, first and second independent encoded streams each comprise first and second stereo channels for frequency bands below a predefined limit and a mono channel for frequency bands above the predefined limit (e.g., the streams are in joint stereo mode). The combining operation 1014 includes separately mixing the first stereo channels, second stereo channels, and mono channels of the first and second independent encoded streams to generate the output bitstream.

In some embodiments, a first independent audio source stream of the plurality of independent audio source streams comprises a continuous source of non-silent audio data (e.g., background music for a video game) and a second independent audio source stream of the plurality of independent audio source streams comprises a second episodic source of non-silent audio data (e.g., a non-continuous sound effect for a video game). In some embodiments, a first independent audio source stream of the plurality of independent audio source streams comprises a first episodic source of non-silent audio data (e.g., a first non-continuous sound effect for a video game) and a second independent audio source stream of the plurality of independent audio source streams comprises a second episodic source of non-silent audio data (e.g., a second non-continuous sound effect for a video game).

Figure 10B:
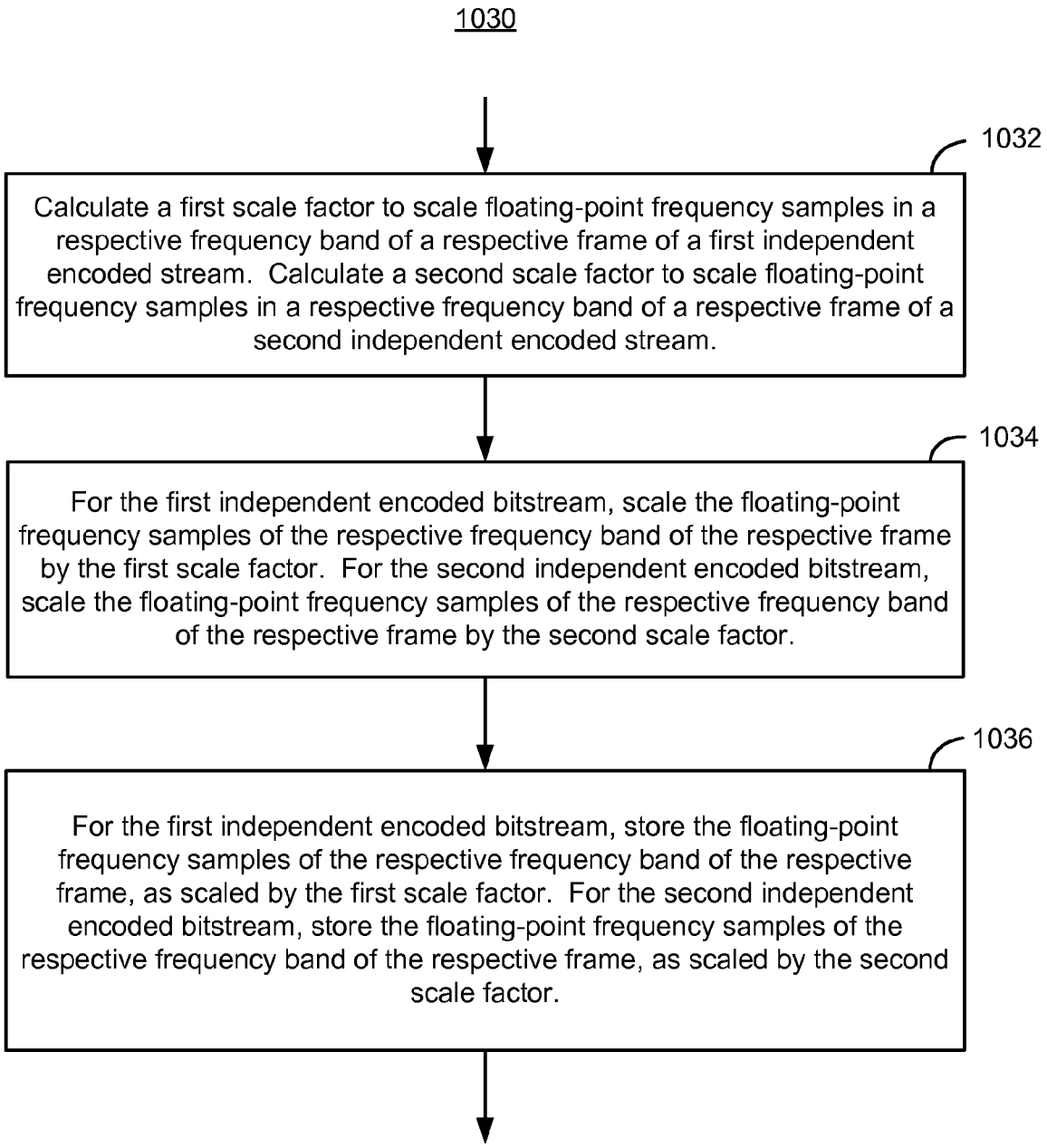

FIG. 10B is a flow diagram illustrating a process 1030 for use as part of the encoding operation 1004 (FIG. 10A). In the method 1030, a first scale factor is calculated (1032) to scale floating-point frequency samples in a respective frequency band of a respective frame of a first independent encoded stream. A second scale factor is calculated (1032) to scale floating-point frequency samples in a respective frequency band of a respective frame of a second independent encoded stream. In some embodiments, the scale factor calculations are performed by the frame-wide scale factor calculation module 442 (FIG. 4B) or 462 (FIGS. 4C and 6).

For the first independent encoded bitstream, the floating-point frequency samples of the respective frequency band of the respective frame are scaled (1034) by the first scale factor. For the second independent encoded bitstream, the floating-point frequency samples of the respective frequency band of the respective frame are scaled (1034) by the second scale factor. In some embodiments, the scaling is performed by the scaling and quantization module 412 (FIG. 4B) or the high-precision scaling module 464 (FIGS. 4C and 6).

For the first independent encoded bitstream, the floating-point frequency samples of the respective frequency band of the respective frame are stored (1036) as scaled by the first scale factor. For the second independent encoded bitstream, the floating-point frequency samples of the respective frequency band of the respective frame are stored (1036) as scaled by the second scale factor. The first and second scale factors thus function as common exponents for storing respective floating-point frequency samples of respective frequency bands and frames in respective encoded bitstreams.

Figure 10C:
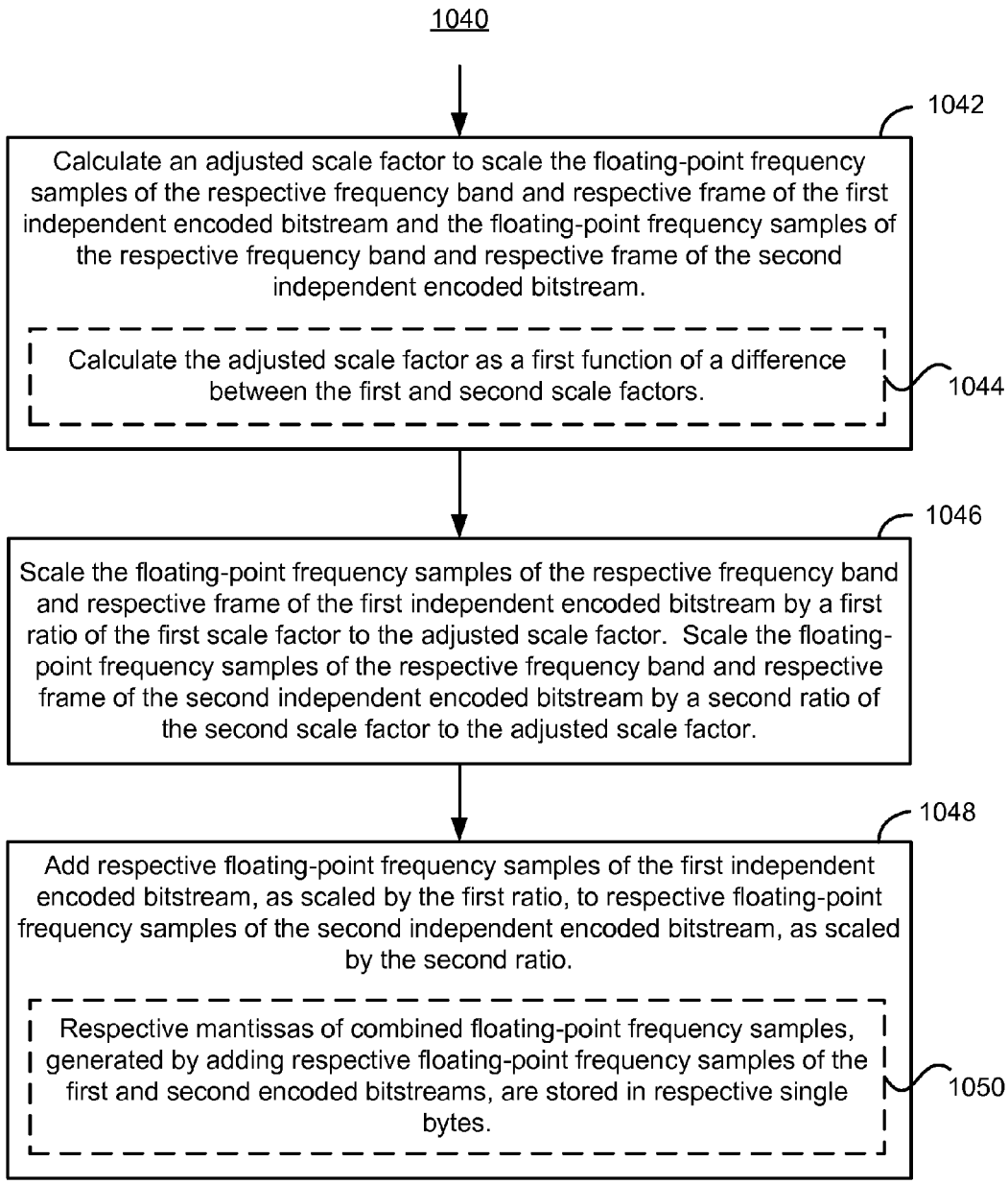

FIG. 10C is a flow diagram illustrating a process 1040 for use as part of the combining operation 1014 (FIG. 10A). In the method 1040, an adjusted scale factor is calculated (1042) to scale the floating-point frequency samples of the respective frequency band and respective frame of the first independent encoded bitstream and the floating-point frequency samples of the respective frequency band and respective frame of the second independent encoded bitstream.

In some embodiments, the adjusted scale factor is calculated (1044) as a first function of a difference between the first and second scale factors (e.g., in accordance with the process 500, FIG. 5). In some embodiments, the first function includes addition of an offset to the first or second scale factor, the offset being a monotonic second function of the magnitude of the difference between the first and second scale factors. In some embodiments, the first, second, and adjusted scale factors are encoded as indices referencing scale factor values stored in a table (e.g., in accordance with Equation (1)) and the difference between the first and second scale factors is calculated by subtracting the smaller of the indices corresponding to the first and second scale factors from the larger of the indices corresponding to the first and second scale factors (e.g., in accordance with operation 504, FIG. 5). In some embodiments, the first function comprises subtraction of an offset from the lower of the indices encoding the first or second scale factor, the offset being a monotonic second function of the magnitude of the difference between the indices encoding the first and second scale factors.

The floating-point frequency samples of the respective frequency band and respective frame of the first independent encoded bitstream are scaled (1046) by a first ratio of the first scale factor to the adjusted scale factor. The floating-point frequency samples of the respective frequency band and respective frame of the second independent encoded bitstream are scaled (1046) by a second ratio of the second scale factor to the adjusted scale factor. In some embodiments, the scaling is performed by the scaling and quantization module 412 (FIG. 4B) or the high-precision scaling module 464 (FIGS. 4C and 6).

Respective floating-point frequency samples of the first independent encoded bitstream, as scaled by the first ratio, are added (1048) to respective floating-point frequency samples of the second independent encoded bitstream, as scaled by the second ratio (e.g., in accordance with operations 804 and 806 of the process 800, FIG. 8). In some embodiments, respective mantissas of combined floating-point frequency samples, generated by adding respective floating-point frequency samples of the first and second encoded bitstreams, are stored (1050) in respective single bytes. In some embodiments (e.g., if mantissas of FP frequency samples are stored using 16 bits), respective mantissas of combined FP frequency samples are stored using more than one byte (e.g., are stored using 16 bits).

In some embodiments, a determination is made that a combined floating-point frequency sample, generated by adding respective floating-point frequency samples of the first and second encoded bitstreams, exceeds a predefined limit (or, for negative numbers, is less than a predefined limit). In response to the determination, the combined floating-point frequency sample is assigned to equal the predefined limit, to prevent clipping.

Figure 10D:
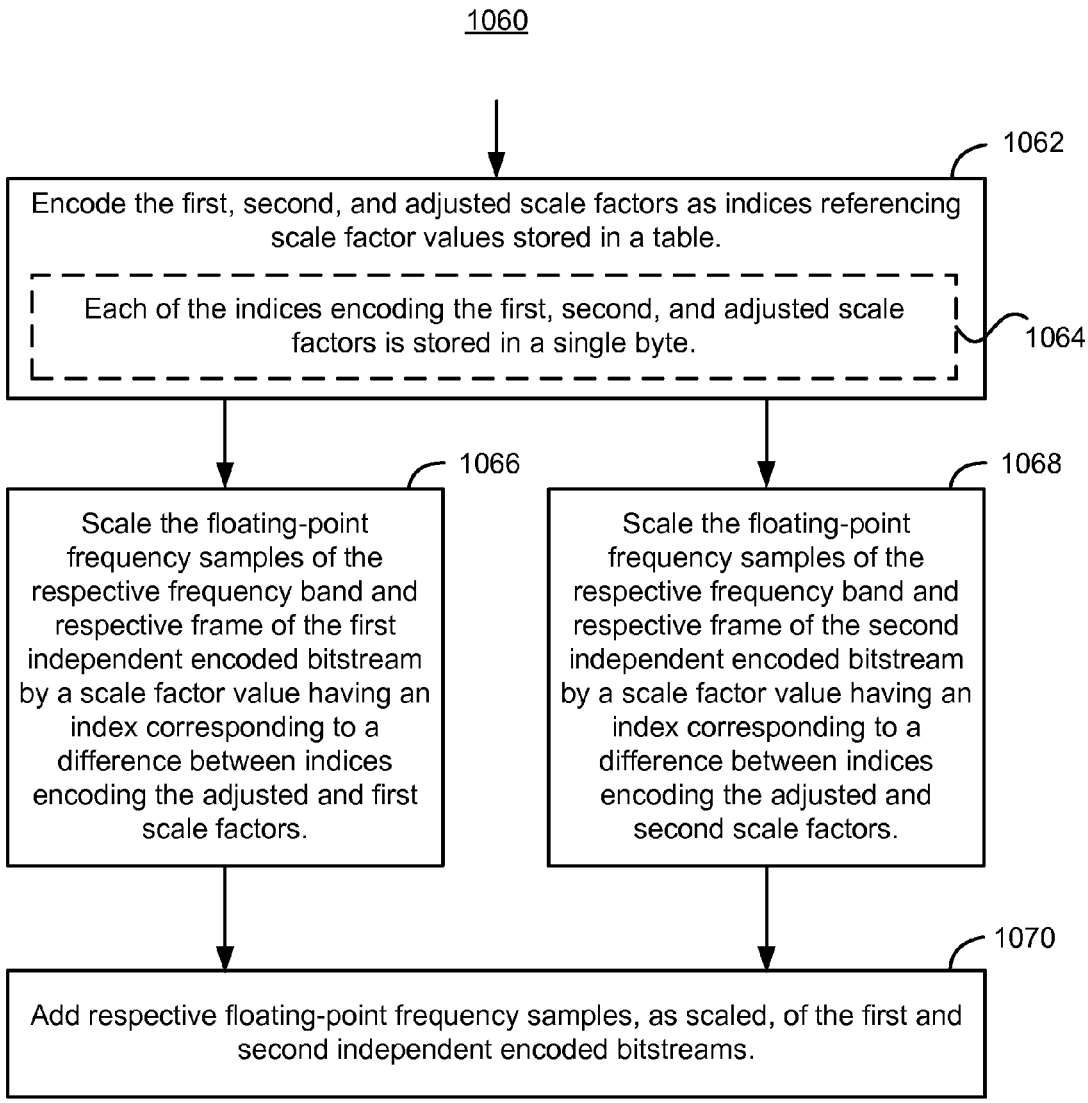

FIG. 10D is a flow diagram illustrating a process 1060 for use as part of the encoding operation 1004 and combining operation 1014 (FIG. 10A). In the method 1060, the first, second, and adjusted scale factors are encoded (1062) as indices referencing scale factor values stored in a table (e.g., in accordance with Equation (1)). In some embodiments, each of the indices encoding the first, second, and adjusted scale factors is stored (1064) in a single respective byte.

The floating-point frequency samples of the respective frequency band and respective frame of the first independent encoded bitstream are scaled (1066) by a scale factor value having an index corresponding to a difference between indices encoding the adjusted and first scale factors. The floating-point frequency samples of the respective frequency band and respective frame of the second independent encoded bitstream are scaled (1068) by a scale factor value having an index corresponding to a difference between indices encoding the adjusted and second scale factors.

Respective floating-point frequency samples, as scaled, of the first and second independent encoded bitstreams are added (1070) (e.g., in accordance with operations 804 and 806 of the process 800, FIG. 8).

The process 1000 (FIG. 10A), including the processes 1030 (FIG. 10B), 1040 (FIG. 10C), and 1060 (FIG. 10D), enables fast, computationally efficient real-time mixing of encoded (or, in other words, compressed-domain) audio data. While the process 1000 includes a number of operations that appear to occur in a specific order, it should be apparent that the process 1000 can include more or fewer operations, which can be executed serially or in parallel (e.g., using parallel processors or a multi-threading environment), an order of two or more operations may be changed and/or two or more operations may be combined into a single operation.

In some embodiments, the operations 1002 and 1004 (including, for example, operations 1006, 1008, and/or 1010) of the process 1000 are performed prior to execution of a video game, while the operations 1012-1020 of the process 1000 are performed during execution of the video game. The operations 1002 and 1004 thus are performed off-line while the operations 1012-1020 are performed on-line in real time. Furthermore, in some embodiments various operations of the process 1000 are performed at different systems. For example, the operations 1002 and 1004 are performed at an off-line system such as a game developer workstation. The resulting plurality of independent encoded streams then is provided to and stored in computer memory (i.e., in a computer-readable storage medium) in a video game system 200 (FIG. 2), such as one or more game servers 116 (FIG. 1) in the cable TV system 100, and the operations 1012-1020 are performed at the video game system 200 during execution of a video game. Alternatively, the entire process 1000 is performed at a video-game system 200 (FIG. 2), which may be implemented as part of the cable TV system 100 (FIG. 1).

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A method of encoding audio, comprising:

at an audio encoding system including one or more processors and memory, during execution of a video game by a computer system:

receiving an instruction to mix a first independent encoded audio stream with a second independent encoded audio stream, the first and second independent encoded audio streams each comprising a sequence of frames, wherein respective frames of each sequence comprise floating-point frequency samples divided into a plurality of frequency bands, the floating-point frequency samples of a respective frequency band of a respective frame of the first independent encoded audio stream being scaled by a first scale factor, the floating-point frequency samples of a respective frequency band of a respective frame of the second independent encoded audio stream being scaled by a second scale factor;

in response to the instruction to mix the first independent encoded audio stream with the second independent encoded audio stream, combining respective floating-point frequency samples of the first and second independent encoded audio streams, the combining comprising:

calculating an adjusted scale factor as a first function of a difference between the first and second scale factors;

scaling the floating-point frequency samples of the respective frequency band of the respective frame of the first independent encoded audio stream by a first ratio of the first scale factor to the adjusted scale factor;

scaling the floating-point frequency samples of the respective frequency band of the respective frame of the second independent encoded audio stream by a second ratio of the second scale factor to the adjusted scale factor; and adding respective floating-point frequency samples of the first independent encoded audio stream, as scaled by the first ratio, to respective floating-point frequency samples of the second independent encoded audio stream, as scaled by the second ratio; and generating an output bitstream comprising the combined respective floating-point frequency samples.

2. The method of claim 1, further comprising transmitting the output bitstream to a client device for decoding and playback.

3. The method of claim 1, wherein the combining further comprises:

determining that a combined floating-point frequency sample, generated by adding respective floating-point frequency samples of the first and second encoded bitstreams, exceeds a predefined limit; and in response to the determination, assigning the combined floating-point frequency sample to equal the predefined limit.

4. The method of claim 1, wherein respective mantissas of combined floating-point frequency samples, generated by adding respective floating-point frequency samples of the first and second encoded bitstreams, are stored in respective single bytes.

5. The method of claim 1, wherein the first, second, and adjusted scale factors are encoded as indices referencing scale factor values stored in a table, the indices each being represented with more than six bits.

6. The method of claim 1, wherein the first function comprises addition of an offset to the first or second scale factor, the offset being a monotonic second function of the magnitude of the difference between the first and second scale factors.

7. The method of claim 1, wherein:

the first, second, and adjusted scale factors are encoded as indices referencing scale factor values stored in a table; and the difference between the first and second scale factors is calculated by subtracting the lower of the indices corresponding to the first and second scale factors from the larger of the indices corresponding to the first and second scale factors.

8. The method of claim 7, wherein the first function comprises subtraction of an offset from the lower of the indices encoding the first or second scale factor, the offset being a monotonic second function of the magnitude of the difference between the indices encoding the first and second scale factors.

9. The method of claim 7, wherein each of the indices encoding the first, second, and adjusted scale factors is stored in a single byte.

10. The method of claim 1, wherein the first, second, and adjusted scale factors are encoded as indices referencing scale factor values stored in a table, the combining further comprising:

scaling the floating-point frequency samples of the respective frequency band and respective frame of the first independent encoded bitstream by a scale factor value having an index corresponding to a difference between indices encoding the adjusted and first scale factors;

scaling the floating-point frequency samples of the respective frequency band and respective frame of the second independent encoded bitstream by a scale factor value having an index corresponding to a difference between indices encoding the adjusted and second scale factors; and adding respective floating-point frequency samples, as scaled, of the first and second independent encoded bitstreams.

11. The method of claim 10, wherein the first, second, and adjusted scale factors are encoded as indices referencing scale factor values stored in a table, the indices each being represented with more than six bits, the combining further comprising:

dividing the index encoding the adjusted scale factor to produce a divided scale factor index being represented by six bits; and writing the divided scale factor index to the encoded bitstream.

12. The method of claim 1, wherein the combining comprises calculating respective sums of respective floating-point frequency samples and dividing the respective sums by a constant value.

13. The method of claim 12, wherein the constant value equals 2 or $\sqrt{2}$.

14. The method of claim 1, wherein:

the first and second independent encoded streams of the plurality of independent encoded streams each comprises a left channel and a right channel; and the combining comprises:

mixing the left channels of the first and second independent encoded streams to generate a left channel of the output bitstream; and mixing the right channels of first and second independent encoded streams to generate a right channel of the output bitstream.

15. The method of claim 1, wherein:

the first independent encoded stream comprises a left channel and a right channel;

the second independent encoded stream comprises a mono channel; and the combining comprises:

mixing the left channel of the first independent encoded stream with the mono channel of the second independent encoded stream to generate a left channel of the output bitstream; and mixing the right channel of the first independent encoded stream with the mono channel of the second independent encoded stream to generate a right channel of the output bitstream.

16. The method of claim 1, wherein:

the first and second independent encoded streams each comprises first and second stereo channels for frequency bands below a predefined limit and a mono channel for frequency bands above the predefined limit; and the combining comprises separately mixing the first stereo channels, second stereo channels, and mono channels of the first and second independent encoded streams.

17. The method of claim 1, wherein:

the first independent encoded audio stream is generated from a first independent audio source stream that comprises a continuous source of non-silent audio data; and the second independent encoded audio stream is generated from a second independent audio source stream that comprises an episodic source of non-silent audio data.

18. The method of claim 1, wherein:

the first independent encoded audio stream is generated from a first independent audio source stream that comprises a first episodic source of non-silent audio data; and the second independent encoded audio stream is generated from a second independent audio source stream that comprises a second episodic source of non-silent audio data.

19. A system for encoding audio, comprising:

memory;

one or more processors;

one or more programs stored in the memory and configured for execution by the one or more processors, the one or more programs including instructions for:

receiving an instruction to mix a first independent encoded audio stream with a second independent encoded audio stream, the first and second independent encoded audio streams each comprising a sequence of frames, wherein respective frames of each sequence comprise floating-point frequency samples divided into a plurality of frequency bands, the floating-point frequency samples of a respective frequency band of a respective frame of the first independent encoded audio stream being scaled by a first scale factor, the floating-point frequency samples of a respective frequency band of a respective frame of the second independent encoded audio stream being scaled by a second scale factor;

in response to the instruction to mix the first independent encoded audio stream with the second independent encoded audio stream, combining the respective floating-point frequency samples of the first and second independent encoded audio streams, the combining comprising:

calculating an adjusted scale factor as a first function of a difference between the first and second scale factors;

scaling the floating-point frequency samples of the respective frequency band of the respective frame of the first independent encoded audio stream by a first ratio of the first scale factor to the adjusted scale factor;

scaling the floating-point frequency samples of the respective frequency band of the respective frame of the second independent encoded audio stream by a second ratio of the second scale factor to the adjusted scale factor; and adding respective floating-point frequency samples of the first independent encoded audio stream, as scaled by the first ratio, to respective floating-point frequency samples of the second independent encoded audio stream, as scaled by the second ratio; and generating an output bitstream comprising the combined respective floating-point frequency samples.

20. The system of claim 19, wherein the instructions for combining further comprise instructions for:

determining that a combined floating-point frequency sample, generated by adding respective floating-point frequency samples of the first and second encoded bitstreams, exceeds a predefined limit; and in response to the determination, assigning the combined floating-point frequency sample to equal the predefined limit.

21. The system of claim 19, wherein respective mantissas of combined floating-point frequency samples, generated by adding respective floating-point frequency samples of the first and second encoded bitstreams, are stored in respective single bytes.

22. The system of claim 19, wherein the first, second, and adjusted scale factors are encoded as indices referencing scale factor values stored in a table, the indices each being represented with more than six bits.

23. The system of claim 19, wherein the first function comprises addition of an offset to the first or second scale factor, the offset being a monotonic second function of the magnitude of the difference between the first and second scale factors.

24. The system of claim 19, wherein:

the first, second, and adjusted scale factors are encoded as indices referencing scale factor values stored in a table; and the difference between the first and second scale factors is calculated by subtracting the lower of the indices corresponding to the first and second scale factors from the larger of the indices corresponding to the first and second scale factors.

25. The system of claim 24, wherein the first function comprises subtraction of an offset from the lower of the indices encoding the first or second scale factor, the offset being a monotonic second function of the magnitude of the difference between the indices encoding the first and second scale factors.

26. The system of claim 24, wherein each of the indices encoding the first, second, and adjusted scale factors is stored in a single byte.

27. The system of claim 19, wherein the one or more programs further comprise instructions for transmitting the output bitstream to a client device for decoding and playback.

28. The system of claim 19, wherein the first, second, and adjusted scale factors are encoded as indices referencing scale factor values stored in a table, and the instructions for combining further comprise instructions for:

scaling the floating-point frequency samples of the respective frequency band and respective frame of the first independent encoded bitstream by a scale factor value having an index corresponding to a difference between indices encoding the adjusted and first scale factors;

scaling the floating-point frequency samples of the respective frequency band and respective frame of the second independent encoded bitstream by a scale factor value having an index corresponding to a difference between indices encoding the adjusted and second scale factors; and adding respective floating-point frequency samples, as scaled, of the first and second independent encoded bitstreams.

29. The system of claim 28, wherein the first, second, and adjusted scale factors are encoded as indices referencing scale factor values stored in a table, the indices each being represented with more than six bits, and the instructions for combining further comprise instructions for:

dividing the index encoding the adjusted scale factor to produce a divided scale factor index being represented by six bits; and writing the divided scale factor index to the encoded bitstream.

30. The system of claim 19, wherein the instructions for combining further comprise instructions for calculating respective sums of respective floating-point frequency samples and dividing the respective sums by a constant value.

31. The system of claim 30, wherein the constant value equals 2 or $\sqrt{2}$.

32. The system of claim 19, wherein:

the first and second independent encoded streams of the plurality of independent encoded streams each comprises a left channel and a right channel; and the instructions for combining further comprise instructions for:

mixing the left channels of the first and second independent encoded streams to generate a left channel of the output bitstream; and mixing the right channels of first and second independent encoded streams to generate a right channel of the output bitstream.

33. The system of claim 19, wherein:

the first independent encoded stream comprises a left channel and a right channel;

the second independent encoded stream comprises a mono channel; and the instructions for combining further comprise instructions for:

mixing the left channel of the first independent encoded stream with the mono channel of the second independent encoded stream to generate a left channel of the output bitstream; and mixing the right channel of the first independent encoded stream with the mono channel of the second independent encoded stream to generate a right channel of the output bitstream.

34. The system of claim 19, wherein:

the first and second independent encoded streams each comprises first and second stereo channels for frequency bands below a predefined limit and a mono channel for frequency bands above the predefined limit; and the instructions for combining further comprise instructions for separately mixing the first stereo channels, second stereo channels, and mono channels of the first and second independent encoded streams.

35. The system of claim 19, wherein:

the first independent encoded audio stream is generated from a first independent audio source stream that comprises a continuous source of non-silent audio data; and the second independent encoded audio stream is generated from a second independent audio source stream that comprises an episodic source of non-silent audio data.

36. The system of claim 19, wherein:

the first independent encoded audio stream is generated from a first independent audio source stream that comprises a first episodic source of non-silent audio data; and the second independent encoded audio stream is generated from a second independent audio source stream that comprises a second episodic source of non-silent audio data.

37. A non-transitory computer readable storage medium storing one or more programs, the one or more programs comprising instructions, which when executed by a computer system, cause the computer system to:

receive an instruction to mix a first independent encoded audio stream with a second independent encoded audio stream, the first and second independent encoded audio streams each comprising a sequence of frames, wherein respective frames of each sequence comprise floating-point frequency samples divided into a plurality of frequency bands, the floating-point frequency samples of a respective frequency band of a respective frame of the first independent encoded audio stream being scaled by a first scale factor, the floating-point frequency samples of a respective frequency band of a respective frame of the second independent encoded audio stream being scaled by a second scale factor;

in response to the instruction to mix the first independent encoded audio stream with the second independent encoded audio stream, combine the respective floating-point frequency samples of the first and second independent encoded audio streams the combining comprising:

calculating an adjusted scale factor as a first function of a difference between the first and second scale factors;

scaling the floating-point frequency samples of the respective frequency band of the respective frame of the first independent encoded audio stream by a first ratio of the first scale factor to the adjusted scale factor;

scaling the floating-point frequency samples of the respective frequency band of the respective frame of the second independent encoded audio stream by a second ratio of the second scale factor to the adjusted scale factor; and adding respective floating-point frequency samples of the first independent encoded audio stream, as scaled by the first ratio, to respective floating-point frequency samples of the second independent encoded audio stream, as scaled by the second ratio; and generate an output bitstream comprising the combined respective floating-point frequency samples.

38. The non-transitory computer readable storage medium of claim 37, wherein the one or more programs further comprise instructions which, when executed by the computer system, cause the computer system to:

determine that a combined floating-point frequency sample, generated by adding respective floating-point frequency samples of the first and second encoded bitstreams, exceeds a predefined limit; and in response to the determination, assign the combined floating-point frequency sample to equal the predefined limit.

39. The non-transitory computer readable storage medium of claim 37, wherein respective mantissas of combined floating-point frequency samples, generated by adding respective floating-point frequency samples of the first and second encoded bitstreams, are stored in respective single bytes.

40. The non-transitory computer readable storage medium of claim 37, wherein the first, second, and adjusted scale factors are encoded as indices referencing scale factor values stored in a table, the indices each being represented with more than six bits.

41. The non-transitory computer readable storage medium of claim 37, wherein the first function comprises addition of an offset to the first or second scale factor, the offset being a monotonic second function of the magnitude of the difference between the first and second scale factors.

42. The non-transitory computer readable storage medium of claim 37, wherein:

the first, second, and adjusted scale factors are encoded as indices referencing scale factor values stored in a table; and the difference between the first and second scale factors is calculated by subtracting the lower of the indices corresponding to the first and second scale factors from the larger of the indices corresponding to the first and second scale factors.

43. The non-transitory computer readable storage medium of claim 42, wherein the first function comprises subtraction of an offset from the lower of the indices encoding the first or second scale factor, the offset being a monotonic second function of the magnitude of the difference between the indices encoding the first and second scale factors.

44. The non-transitory computer readable storage medium of claim 42, wherein each of the indices encoding the first, second, and adjusted scale factors is stored in a single byte.

45. The non-transitory computer readable storage medium of claim 37, wherein the one or more programs further comprise instructions which, when executed by the computer system, cause the computer system to transmit the output bitstream to a client device for decoding and playback.

46. The non-transitory computer readable storage medium of claim 37, wherein the first, second, and adjusted scale factors are encoded as indices referencing scale factor values stored in a table, and the instructions to combine further comprise instructions which, when executed by the computer system, cause the computer system to:

scale the floating-point frequency samples of the respective frequency band and respective frame of the first independent encoded bitstream by a scale factor value having an index corresponding to a difference between indices encoding the adjusted and first scale factors;

scale the floating-point frequency samples of the respective frequency band and respective frame of the second independent encoded bitstream by a scale factor value having an index corresponding to a difference between indices encoding the adjusted and second scale factors; and add respective floating-point frequency samples, as scaled, of the first and second independent encoded bitstreams.

47. The non-transitory computer readable storage medium of claim 46, wherein the first, second, and adjusted scale factors are encoded as indices referencing scale factor values stored in a table, the indices each being represented with more than six bits, and the instructions to combine further comprise instructions which, when executed by the computer system, cause the computer system to:

divide the index encoding the adjusted scale factor to produce a divided scale factor index being represented by six bits; and write the divided scale factor index to the encoded bitstream.

48. The non-transitory computer readable storage medium of claim 37, wherein the instructions to combine further comprise instructions which, when executed by the computer system, cause the computer system to calculate respective sums of respective floating-point frequency samples and dividing the respective sums by a constant value.

49. The non-transitory computer readable storage medium of claim 48, wherein the constant value equals 2 or $\sqrt{2}$.

50. The non-transitory computer readable storage medium of claim 37, wherein:

the first and second independent encoded streams of the plurality of independent encoded streams each comprises a left channel and a right channel; and the instructions to combine further comprise instructions which, when executed by the computer system, cause the computer system to:

mix the left channels of the first and second independent encoded streams to generate a left channel of the output bitstream; and mix the right channels of first and second independent encoded streams to generate a right channel of the output bitstream.

51. The non-transitory computer readable storage medium of claim 37, wherein:

the first independent encoded stream comprises a left channel and a right channel;

the second independent encoded stream comprises a mono channel; and the instructions to combine further comprise instructions which, when executed by the computer system, cause the computer system to:

mix the left channel of the first independent encoded stream with the mono channel of the second independent encoded stream to generate a left channel of the output bitstream; and mix the right channel of the first independent encoded stream with the mono channel of the second independent encoded stream to generate a right channel of the output bitstream.

52. The non-transitory computer readable storage medium of claim 37, wherein:

the first and second independent encoded streams each comprises first and second stereo channels for frequency bands below a predefined limit and a mono channel for frequency bands above the predefined limit; and the instructions to combine further comprise instructions which, when executed by the computer system, cause the computer system to separately mix the first stereo channels, second stereo channels, and mono channels of the first and second independent encoded streams.

53. The non-transitory computer readable storage medium of claim 37, wherein:

the first independent encoded audio stream is generated from a first independent audio source stream that comprises a continuous source of non-silent audio data; and the second independent encoded audio stream is generated from a second independent audio source stream that comprises an episodic source of non-silent audio data.

54. The non-transitory computer readable storage medium of claim 37, wherein:

the first independent encoded audio stream is generated from a first independent audio source stream that comprises a first episodic source of non-silent audio data; and the second independent encoded audio stream is generated from a second independent audio source stream that comprises a second episodic source of non-silent audio data.

* * * * *